US009440112B2

(12) United States Patent
Yamada et al.

(10) Patent No.: US 9,440,112 B2
(45) Date of Patent: Sep. 13, 2016

(54) BAT SELECTION DEVICE AND BAT SELECTION METHOD

(71) Applicant: Mizuno Corporation, Osaka (JP)

(72) Inventors: Yuki Yamada, Osaka (JP); Yasuyuki Ohta, Osaka (JP); Yohei Yamashita, Osaka (JP)

(73) Assignee: Mizuno Corporation, Osaka (JP)

( * ) Notice: Subject to any disclaimer, the term of this patent is extended or adjusted under 35 U.S.C. 154(b) by 28 days.

(21) Appl. No.: 14/188,026

(22) Filed: Feb. 24, 2014

(65) Prior Publication Data

US 2014/0244011 A1 Aug. 28, 2014

(30) Foreign Application Priority Data

Feb. 26, 2013 (JP) ..... 2013-035960
Feb. 4, 2014 (JP) ..... 2014-019337

(51) Int. Cl.
*A63B 71/06* (2006.01)
*A63B 24/00* (2006.01)
*A63B 69/00* (2006.01)

(52) U.S. Cl.
CPC ..... *A63B 24/0003* (2013.01); *A63B 69/0075* (2013.01); *A63B 2069/0008* (2013.01); *A63B 2220/13* (2013.01); *A63B 2220/34* (2013.01); *A63B 2220/805* (2013.01)

(58) Field of Classification Search
USPC ..... 700/90, 91; 473/564, 451; 463/564, 451
See application file for complete search history.

(56) References Cited

U.S. PATENT DOCUMENTS 5,118,102 A * 6/1992 Bahill et al. ..... 473/564
2006/0211523 A1* 9/2006 Sabatino ..... 473/453
2007/0021242 A1* 1/2007 Krickler ..... 473/451
2011/0299729 A1* 12/2011 Dawe et al. ..... 382/103

FOREIGN PATENT DOCUMENTS

JP 2011-142927 A 7/2011

* cited by examiner

*Primary Examiner* — Paul A D'Agostino
*Assistant Examiner* — Brandon Gray
(74) *Attorney, Agent, or Firm* — Troutman Sanders LLP; James Schutz; Daniel Sharpe

(57) ABSTRACT

A bat selection device includes: a parameter input unit which receives an input of a swing parameter value relevant to swing of a batter, for each of at least two or more bats having moments of inertia different from one another swung by the batter at an object, of a plurality of bats; an estimation unit which estimates the swing parameter value corresponding to each of the plurality of bats based on each received swing parameter value; and a selection unit which calculates an index parameter value indicative of an index for selecting a bat suitable for the batter from the plurality of bats, for each of the plurality of bats, based on the estimated swing parameter value corresponding to the bat, and selects the bat suitable for the batter based on the index parameter values.

13 Claims, 21 Drawing Sheets

FIG.7

$$M = \frac{1}{\frac{1}{m_1} + \frac{r^2}{Icg}}$$

M: REDUCED MASS
$m_1$: BAT MASS
r: (CENTER OF GRAVITY OF BAT - HITTING POSITION)
Icg: MOMENT OF INERTIA ABOUT CENTER OF GRAVITY OF BAT

FIG.8

$$Vout = \frac{1+COR}{1+\frac{m_2}{M}} \times (Vs + Vin) - Vin$$

Vout: BALL LAUNCH SPEED
COR: COEFFICIENT OF RESTITUTION
$m_2$: BALL MASS
Vs: SWING SPEED
Vin: PITCHING SPEED

FIG.12

500

INPUT DATA

| | | |
|---|---|---|
| NAME | Tanaka | 510 |
| AGE | 18 | |
| TEAM NAME | A | |

BAT 520

| | |
|---|---|
| First | 32inch(-9) |
| Second | 33inch(-9) |
| Third | 34inch(-9) |

PITCHING SPEED 540

| |
|---|
| 50.0 km/h |
| 31.1 mile/h |

SWING DATA 530

| First | SWING SPEED [m/s] | HITTING POSITION [mm] |
|---|---|---|
| 1 | 33.6 | 755.3 |
| 2 | 33.0 | 745.3 |
| 3 | 33.0 | 725.3 |
| Second | | |
| 1 | 35.4 | 785.7 |
| 2 | 35.4 | 763.2 |
| 3 | 36.2 | 803.2 |
| Third | | |
| 1 | 32.9 | 761.1 |
| 2 | 32.9 | 771.1 |
| 3 | 32.4 | 773.6 |

550

START ANALYSIS

600

OUTPUT DATA

No.1

610

| | | | |
|---|---|---|---|
| BAT | 34inch(−8) | | |
| HEAD SPEED | 81.8 mile/h | = | 36.6 m/s |
| BALL SPEED | 73.7 mile/h | = | 118.7 km/h |
| FLYING DISTANCE | 175.6 feet | = | 53.5 m |

No.2

620

| | | | |
|---|---|---|---|
| BAT | 33inch(−8) | | |
| FLYING DISTANCE | 168.8 feet | = | 51.5 m/s |

No.3

630

| | | | |
|---|---|---|---|
| BAT | 34inch(−9) | | |
| FLYING DISTANCE | 168.8 feet | = | 51.4 m |

FIG.14

(PROCEDURE A)

| SPECIFICATION INFORMATION | | |
|---|---|---|
| No. | LENGTH [mm] | MOI[oz·in^2] |
| 1 | 810 | 5800 |
| 2 | 810 | 6217 |
| 3 | 810 | 6648 |
| 4 | 838 | 6488 |
| 5 | 840 | 7013 |
| 6 | 839 | 7311 |
| 7 | 861 | 7018 |
| 8 | 861 | 7457 |
| 9 | 861 | 8161 |

→

(PROCEDURE B)

| SWING PARAMETER | | |
|---|---|---|
| No. | HITTING POSITION[mm] | SWING SPEED [m/s] |
| 1 | | |
| 2 | 694.2 | 30.1 |
| 3 | | |
| 4 | | |
| 5 | 682.5 | 28.1 |
| 6 | | |
| 7 | | |
| 8 | 702.7 | 28.5 |
| 9 | | |

→

(PROCEDURE C)

| PREPARATION FOR ESTIMATION | | |
|---|---|---|
| No. | HITTING POSITION RATIO | ANGULAR VELOCITY[rad/s] |
| 1 | | |
| 2 | 85.7% | 43.4 |
| 3 | | |
| 4 | | |
| 5 | 81.3% | 41.2 |
| 6 | | |
| 7 | | |
| 8 | 81.6% | 40.6 |
| 9 | | |

(PROCEDURE D)

| AVERAGE HITTING POSITION RATIO | REGRESSION EXPRESSION BETWEEN MOI AND ANGULAR VELOCITY |
|---|---|
| 82.9% | SLOPE: −0.0024<br>INTERCEPT: 58.0 |

→

(PROCEDURE E)

| ESTIMATION | | |
|---|---|---|
| No. | ESTIMATED HITTING POSITION[mm] | ESTIMATED SWING SPEED[m/s] |
| 1 | 671.1 | 29.7 |
| 2 | 671.1 | 29.1 |
| 3 | 671.1 | 28.4 |
| 4 | 694.3 | 29.6 |
| 5 | 696.0 | 28.8 |
| 6 | 695.1 | 28.3 |
| 7 | 713.4 | 29.6 |
| 8 | 713.4 | 28.8 |
| 9 | 713.4 | 27.6 |

→

(PROCEDURE F)

| LAUNCH SPEED[m/s] | | |
|---|---|---|
| No. | CALCULATED FROM MEASURED VALUE | CALCULATED FROM ESTIMATED VALUE |
| 1 | – | 30.1 |
| 2 | – | 30.1 |
| 3 | – | 30.0 |
| 4 | – | 30.3 |
| 5 | – | 30.1 |
| 6 | – | 30.0 |
| 7 | – | 30.3 |
| 8 | – | 30.1 |
| 9 | – | 29.6 |

FIG.17

(PROCEDURE A)

| SPECIFICATION INFORMATION | | |
|---|---|---|
| No. | LENGTH [mm] | |
| 1 | 810 | 5800 |
| 2 | 810 | 6217 |
| 3 | 810 | 6648 |
| 4 | 838 | 6488 |
| 5 | 840 | 7013 |
| 6 | 839 | 7311 |
| 7 | 861 | 7018 |
| 8 | 861 | 7457 |
| 9 | 861 | 8161 |

(PROCEDURE B)

| SWING PARAMETER | | |
|---|---|---|
| No. | HITTING POSITION[mm] | SWING SPEED [m/s] |
| 1 | | |
| 2 | 694.2 | 30.1 |
| 3 | | |
| 4 | | |
| 5 | 682.5 | 28.1 |
| 6 | | |
| 7 | | |
| 8 | 702.7 | 28.5 |
| 9 | | |

(PROCEDURE C)

| PREPARATION FOR ESTIMATION | | |
|---|---|---|
| No. | HITTING POSITION RATIO | ANGULAR VELOCITY[rad/s] |
| 1 | | |
| 2 | 85.7% | 43.4 |
| 3 | | |
| 4 | | |
| 5 | 81.3% | 41.2 |
| 6 | | |
| 7 | | |
| 8 | 81.6% | 40.6 |
| 9 | | |

(PROCEDURE D)

| AVERAGE HITTING POSITION RATIO | REGRESSION EXPRESSION BETWEEN MOI AND ANGULAR VELOCITY |
|---|---|
| 82.9% | SLOPE: −0.0024<br>INTERCEPT: 58.0 |

(PROCEDURE E)

| ESTIMATION | | |
|---|---|---|
| No. | ESTIMATED HITTING POSITION[mm] | ESTIMATED SWING SPEED[m/s] |
| 1 | 671.1 | 29.7 |
| 2 | | |
| 3 | 671.1 | 28.4 |
| 4 | 694.3 | 29.6 |
| 5 | | |
| 6 | 695.1 | 28.3 |
| 7 | 713.4 | 29.6 |
| 8 | | |
| 9 | 713.4 | 27.6 |

(PROCEDURE F)

| LAUNCH SPEED[m/s] | | |
|---|---|---|
| No. | CALCULATED FROM MEASURED VALUE | CALCULATED FROM ESTIMATED VALUE |
| 1 | – | 30.1 |
| 2 | 30.4 | |
| 3 | – | 30.0 |
| 4 | – | 30.3 |
| 5 | 29.7 | |
| 6 | – | 30.0 |
| 7 | – | 30.3 |
| 8 | 30.1 | |
| 9 | – | 29.6 |

BAT SELECTION DEVICE AND BAT SELECTION METHOD

This nonprovisional application is based on Japanese Patent Application No. 2013-035960 filed on Feb. 26, 2013 and Japanese Patent Application No. 2014-19337 filed on Feb. 4, 2014 with the Japan Patent Office, the entire contents of which are hereby incorporated by reference.

BACKGROUND OF THE INVENTION

1. Field of the Invention

The present invention relates to a technique for selecting a bat.

2. Description of the Background Art

In sports using a bat and a ball, whether a batter succeeds or fails depends on his/her ability to hit the ball. Bats used in baseball, softball, and the like, which are typical such sports, have various types based on differences in weight, length, size, shape, material, and the like. On the other hand, a suitable bat varies from batter to batter, depending on his/her body weight, body height, physical ability, and the like.

When a bat is not suitable for a batter, the batter cannot show his/her ability to the fullest, and cannot obtain a result as desired. Accordingly, it is extremely important for the batter to select a bat suitable for himself/herself in order to perform batting as desired.

Conventionally, a customer (batter) has usually purchased a bat based on the experience of store staff of a sports store. Thus, selection of a bat suitable for a batter has frequently depended on the experience of store staff. Therefore, techniques for selecting a bat suitable for a batter through quantitative evaluation have been proposed.

For example, Japanese Patent Laying-Open No. 2011-142927 discloses a bat selection system selecting a bat suitable for a batter. The bat selection system includes a sensor bat and a data analyzer. The sensor bat includes a kinematic information detection unit, a bat balance adjustment unit, and a transmission unit transmitting data detected by the kinematic information detection unit. The data analyzer includes a type input unit inputting a type aimed at by a batter, a data reception unit receiving data transmitted from the sensor bat, a kinematic information calculation unit calculating kinematic information from the received data, a bat selection unit selecting a bat suitable for the batter based on an evaluation parameter of swing of the batter calculated by analyzing the kinematic information and the type aimed at by the batter, and display means displaying a selected bat and information related to the evaluation parameter.

U.S. Pat. No. 5,118,102 discloses a device determining a bat weight most suitable for a particular individual by calculating a bouncing speed of a ball assumed to have collided with the center of gravity of a bat.

However, according to the technique disclosed in Japanese Patent Laying-Open No. 2011-142927, the batter has to swing a special bat not used in an actual game and the like. Further, since it is necessary for the technique to prepare a special bat, it results in a complicated system configuration. Therefore, there is a need for a technique for selecting a bat without using a special bat and without complicating a system configuration.

In addition, according to the technique disclosed in U.S. Pat. No. 5,118,102, since the moment of inertia of the bat is not taken into consideration, it is not possible to accurately provide a bat most suitable for a batter. Therefore, there is a need for a technique for selecting a bat taking the moment of inertia of the bat into consideration.

SUMMARY OF THE INVENTION

The present disclosure has been made to solve the aforementioned problems, and one object thereof is to provide a bat selection device capable of easily and more accurately select a bat having a weight and a length most suitable for a batter, from a plurality of bats having different weights and lengths.

One object thereof in another aspect is to provide a bat selection method for easily and more accurately selecting a bat having a weight and a length most suitable for a batter, from a plurality of bats having different weights and lengths.

A bat selection device in accordance with an embodiment includes: a parameter input unit configured to receive an input of a swing parameter value relevant to swing of a batter, for each of at least two or more bats having moments of inertia different from one another swung by the batter at an object, of a plurality of bats; an estimation unit configured to estimate the swing parameter value corresponding to each of the plurality of bats based on each swing parameter value received by the parameter input unit; and a selection unit configured to calculate an index parameter value indicative of an index for selecting a bat suitable for the batter who has swung the bats from the plurality of bats, for each of the plurality of bats, based on the estimated swing parameter value corresponding to the bat, and select the bat suitable for the batter from the plurality of bats based on the calculated index parameter values.

Preferably, the swing parameter value includes a hitting position for hitting the object on the bat, and a swing speed at the hitting position immediately before the object is hit by the bat.

Preferably, the selection unit is configured to calculate, for each of the plurality of bats, a speed of the object hit by the bat immediately after hitting, based on the hitting position and the swing speed corresponding to the bat, and select a bat having the maximum calculated speed as the bat suitable for the batter, from the plurality of bats.

Preferably, the estimation unit is configured to calculate, for each of the at least two or more bats which have been swung, a ratio of a length from one end of the bat to the hitting position to a total length of the bat, and estimate the hitting position corresponding to each of the plurality of bats based on the calculated ratio and total lengths of the plurality of bats.

Preferably, the estimation unit is configured to convert, for each of the at least two or more bats which have been swung, the swing speed into an angular velocity about a grip end portion of the bat, obtain a relational expression between the moment of inertia and the angular velocity, and estimate the swing speed corresponding to each of the plurality of bats based on the obtained relational expression and moments of inertia of the plurality of bats.

Preferably, the index parameter value includes a speed of the object hit by the bat immediately after hitting, or a flying distance of the object.

Preferably, the bat selection device further includes: a reference information storage unit configured to store batter information including at least one of age and physical characteristics of the batter, and selection reference information for selecting the bats to be swung by the batter, in a manner associated with each other; a batter information input unit configured to receive an input of the batter information; and a candidate selection unit configured to select the at least two or more bats having the moments of inertia different from one another as candidates to be swung by the batter, from the plurality of bats, based on the batter information received by the batter information input unit and the selection reference information.

Preferably, the hitting position is a measured hitting position on the bat obtained when the batter has hit the object.

Preferably, the swing speed is calculated based on an angular velocity measured by a sensor device attached to a grip end portion of the bat or to the back of a hand of the batter who has swung the bats.

A bat selection method in accordance with another embodiment includes: receiving an input of a swing parameter value relevant to swing of a batter, for each of at least two or more bats having moments of inertia different from one another swung by the batter at an object, of a plurality of bats; estimating the swing parameter value corresponding to each of the plurality of bats based on each received swing parameter value; and calculating an index parameter value indicative of an index for selecting a bat suitable for the batter who has swung the bats from the plurality of bats, for each of the plurality of bats, based on the estimated swing parameter value corresponding to the bat, and selecting the bat suitable for the batter from the plurality of bats based on the calculated index parameter values.

Preferably, the swing parameter value includes a hitting position for hitting the object on the bat, and a swing speed at the hitting position immediately before the object is hit by the bat.

Preferably, the selecting includes calculating, for each of the plurality of bats, a speed of the object hit by the bat immediately after hitting, based on the hitting position and the swing speed corresponding to the bat, and selecting a bat having the maximum calculated speed as the bat suitable for the batter, from the plurality of bats.

Preferably, the estimating includes calculating, for each of the at least two or more bats which have been swung, a ratio of a length from one end of the bat to the hitting position to a total length of the bat, and estimating the hitting position corresponding to each of the plurality of bats based on the calculated ratio and total lengths of the plurality of bats.

Preferably, the estimating includes converting, for each of the at least two or more bats which have been swung, the swing speed into an angular velocity about a grip end portion of the bat, obtaining a relational expression between the moment of inertia and the angular velocity, and estimating the swing speed corresponding to each of the plurality of bats based on the obtained relational expression and moments of inertia of the plurality of bats.

Preferably, the index parameter value includes a speed of the object hit by the bat immediately after hitting, or a flying distance of the object.

Preferably, the bat selection method further includes: preparing batter information including at least one of age and physical characteristics of the batter, and selection reference information for selecting the bats to be swung by the batter, in a manner associated with each other; receiving an input of the batter information; and selecting the at least two or more bats having the moments of inertia different from one another as candidates to be swung by the batter, from the plurality of bats, based on the received batter information and the selection reference information.

Preferably, the hitting position is a measured hitting position on the bat obtained when the batter has hit the object.

Preferably, the hitting position is a predetermined position on the bat.

Preferably, the swing speed is calculated based on an angular velocity measured by a sensor device attached to a grip end portion of the bat or to the back of a hand of the batter who has swung the bats.

A bat selection method in accordance with still another embodiment includes: receiving an input of a swing parameter value relevant to swing of a batter, for each of at least two or more bats having moments of inertia different from one another swung by the batter, of a plurality of bats; estimating the swing parameter value corresponding to each of the plurality of bats based on each received swing parameter value; and calculating an index parameter value indicative of an index for selecting a bat suitable for the batter who has swung the bats from the plurality of bats, for each of the plurality of bats, based on a predetermined position on the bat and the estimated swing parameter value corresponding to the bat, and selecting the bat suitable for the batter from the plurality of bats based on the calculated index parameter values. The swing parameter value is a swing speed of the batter, or an angular velocity measured by a sensor device attached to a grip end portion of the bat or to the back of a hand of the batter.

In an aspect, a bat having a weight and a length most suitable for a batter can be easily and more accurately selected from a plurality of bats having different weights and lengths.

The foregoing and other objects, features, aspects, and advantages of the present invention will become more apparent from the following detailed description of the present invention when taken in conjunction with the accompanying drawings.

BRIEF DESCRIPTION OF THE DRAWINGS

FIG. 7 is a view for illustrating a reduced mass of the bat used for analysis by the bat selection device in accordance with the present embodiment.

FIG. 8 is a view for illustrating a ball launch speed used for analysis by the bat selection device in accordance with the present embodiment.

FIG. 12 is a user interface screen provided by the bat selection device in accordance with the present embodiment.

FIG. 14 is a view for illustrating calculation procedures performed in the bat selection device in accordance with the present embodiment.

FIG. 17 is a view for illustrating calculation procedures performed by the bat selection device in the other aspect.

DESCRIPTION OF THE PREFERRED EMBODIMENTS

Figure 1:
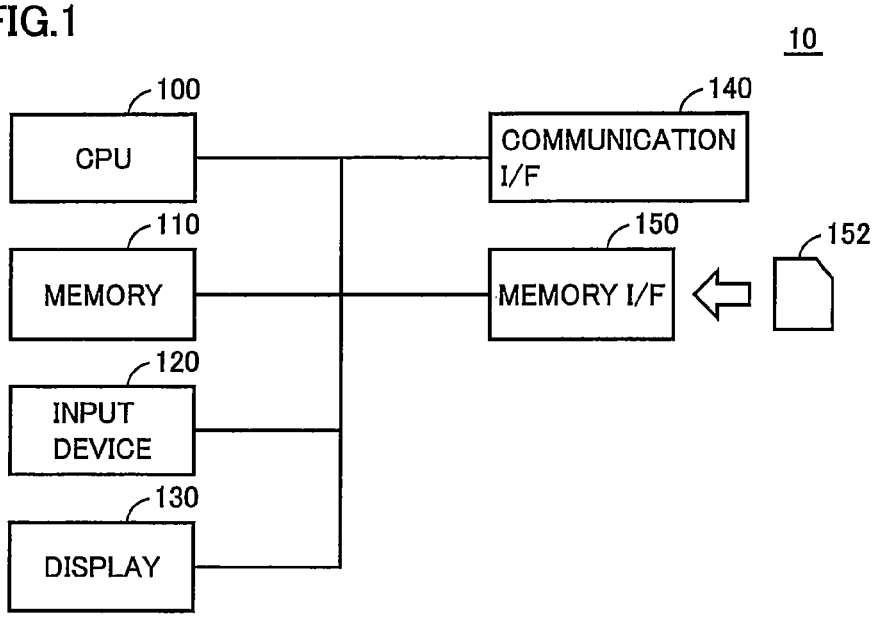
FIG. 1 is a block diagram showing a hardware configuration of a bat selection device in accordance with the present embodiment.

Hereinafter, the present embodiment will be described with reference to the drawings. In the description below, identical parts will be designated by the same reference numerals. Since their names and functions are also the same, the detailed description thereof will not be repeated.

A description will be given below of a case where a bat selection device in accordance with an embodiment is a notebook PC (Personal Computer). The bat selection device can be implemented as any device, regardless of the type thereof. For example, the bat selection device can also be implemented as a desktop PC, a tablet terminal device, a PDA (Personal Digital Assistance), a smartphone, or the like.

<Hardware Configuration>

First, a hardware configuration of a bat selection device 10 in accordance with the present embodiment will be described with reference to FIG. 1.

As shown in FIG. 1, bat selection device 10 includes a CPU (Central Processing Unit) 100, a memory 110, an input device 120, a display 130, a communication interface (I/F) 140, and a memory interface (I/F) 150, as main components.

CPU 100 controls operation of each component of bat selection device 10 by reading and executing a program stored in memory 110. More specifically, CPU 100 implements each of processes (steps) of bat selection device 10 described later by executing the program. CPU 100 is, for example, a microprocessor. It is noted that CPU 100 may be an FPGA (Field Programmable Gate Array), an ASIC (Application Specific Integrated Circuit), another circuit having an arithmetic function, or the like.

Memory 110 is implemented with a RAM (Random Access Memory), a ROM (Read-Only Memory), a hard disk, and the like. Memory 110 stores programs to be executed by CPU 100, data to be used by CPU 100, and the like.

Input device 120 receives an operation input for bat selection device 10. Input device 120 is implemented with, for example, a keyboard, buttons, a mouse, and the like. Further, input device 120 may be implemented as a touch panel.

Display 130 displays images, texts, and other information on a display screen based on signals from CPU 100. For example, CPU 100 causes display 130 to display information about a bat suitable for a batter.

Communication interface (I/F) 140 is a communication interface for exchanging various data between bat selection device 10 and an external device. It is noted that, as a communication system, for example, wireless communication through Bluetooth (registered trademark), a wireless LAN (Local Area Network), and the like may be used, or wire communication utilizing a USB (Universal Serial Bus) and the like may be used.

Memory interface (I/F) 150 reads data from an external storage medium 152. More specifically, CPU 100 reads data stored in external storage medium 152 through memory interface 150 and stores the data in memory 110. CPU 100 reads data from memory 110 and stores the data in external storage medium 152 through memory interface 150.

It is noted that, as storage medium 152, a medium storing a program in a non-volatile manner is used, including a CD (Compact Disc), a DVD (Digital Versatile Disk), a BD (Blu-ray Disc), a USB (Universal Serial Bus) memory, a memory card, an FD (Flexible Disk), a hard disk, a magnetic tape, a cassette tape, an MO (Magnetic Optical Disc), an MD (Mini Disc), an IC (Integrated Circuit) card (except for a memory card), an optical card, an EPROM, an EEPROM (Electronically Erasable Programmable Read-Only Memory), and the like.

<Operation Outline>

Next, an operation outline of bat selection device 10 in accordance with the present embodiment will be described.

(Regarding Prepared Bats)

Bat selection device 10 stores specification information of a plurality of bats prepared beforehand, in memory 110. The specification information is, for example, the length (total length), the moment of inertia (MOI), the weight, and the like of each bat. For example, the plurality of bats prepared beforehand are bats prepared in a store selling bats.

The relation between the length and the moment of inertia in the plurality of bats prepared beforehand in accordance with the present embodiment will be described with reference to FIG. 2.

Figure 2:
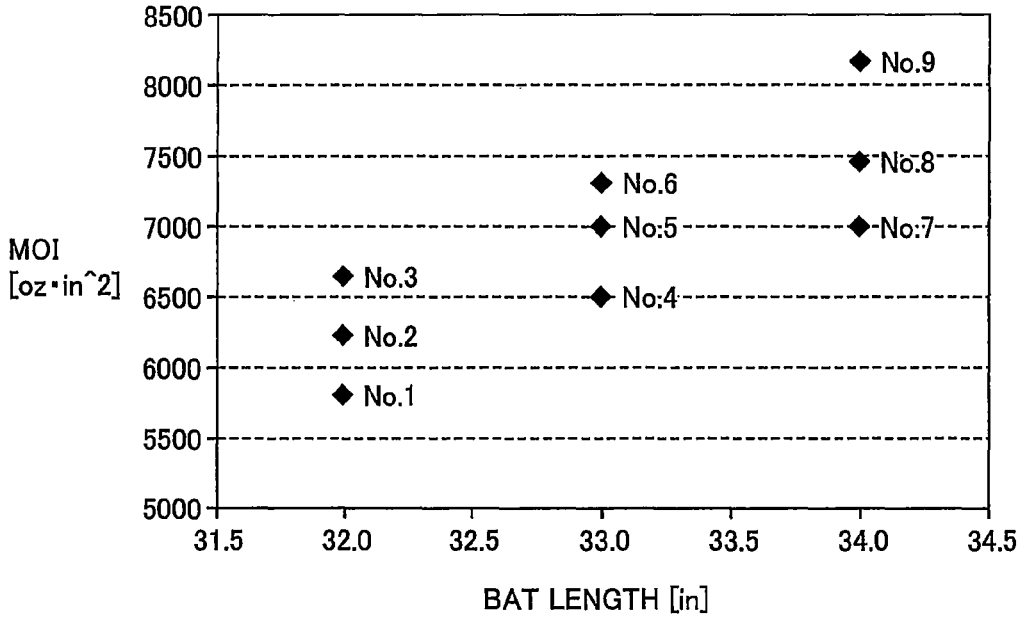
FIG. 2 is a view showing the relation between the length and the moment of inertia in a plurality of bats prepared beforehand in accordance with the present embodiment.

As shown in FIG. 2, bats of No. 1 to No. 3 have a length of 32 inches and moments of inertia different from one another. Similarly, bats of No. 4 to No. 6 have a length of 33 inches and moments of inertia different from one another, and bats of No. 7 to No. 9 have a length of 34 inches and moments of inertia different from one another.

Hereinafter, a description will be given of a case where the above nine bats of No. 1 to No. 9 are prepared beforehand and specification information of the nine bats is stored in memory 110 of bat selection device 10, as a concrete example of the present embodiment.

(Selection of Bats to be Swung)

First, bat selection device 10 selects candidate bats to be swung by the batter from the nine bats. More specifically, bat selection device 10 receives inputs of the name and the age of the batter through input device 120. In accordance with the input age, bat selection device 10 selects at least two or more bats (three bats in this example) to be swung by the batter, from the prepared plurality of bats (the nine bats in this example). On this occasion, the selected three bats are bats at least having moments of inertia different from one another. It is noted that memory 110 of bat selection device 10 stores selection reference information for selecting the bats to be swung by the batter, so as to be associated with the age. Here, it is assumed that bat selection device 10 selects the bats of No. 2, No. 5, and No. 8 having bat lengths and moments of inertia different from one another.

(Input of Swing Parameter Value)

Next, bat selection device 10 receives an input of a swing parameter value relevant to swing of the batter, for each of the selected three bats. Here, bat selection device 10 receives inputs of a hitting position for hitting a ball on the bat, and a swing speed at the hitting position immediately before the ball is hit by the bat, as the swing parameter value.

Figure 3A:
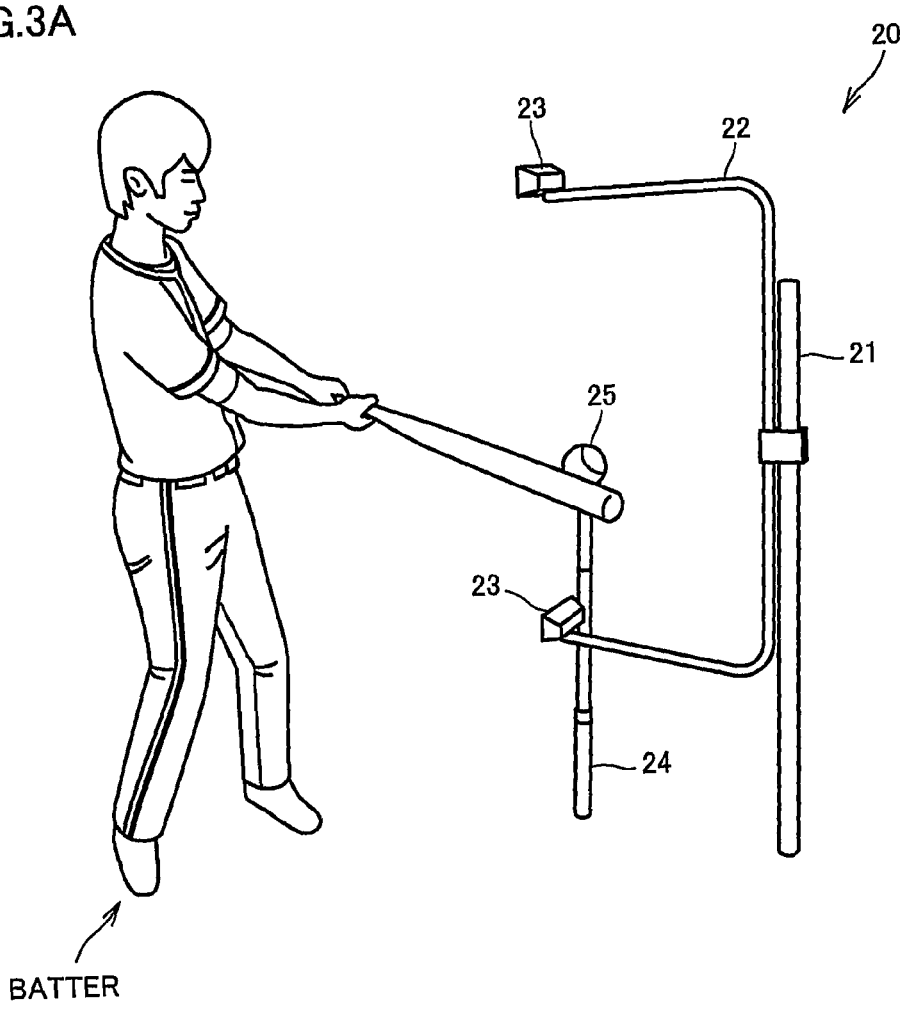
FIG. 3A is a view showing a situation where a batter swings a bat in the vicinity of a swing speed measurement device in accordance with the present embodiment.

More specifically, first, the batter swings each of the selected three bats at a ball a plurality of times (here, three times). For example, the batter performs tee batting as shown in FIG. 3A. The reason for having the batter swing each bat a plurality of times is to obtain an average value of ability relevant to the swing of the batter. Therefore, a plurality of swings are not necessarily required.

A situation where the batter swings a bat in the vicinity of a swing speed measurement device 20 in accordance with the present embodiment will be described with reference to FIG. 3A. The positional relation between optical sensors 23 and a tee 24 included in swing speed measurement device 20 in accordance with the present embodiment will be described with reference to FIG. 3B.

Figure 3B:
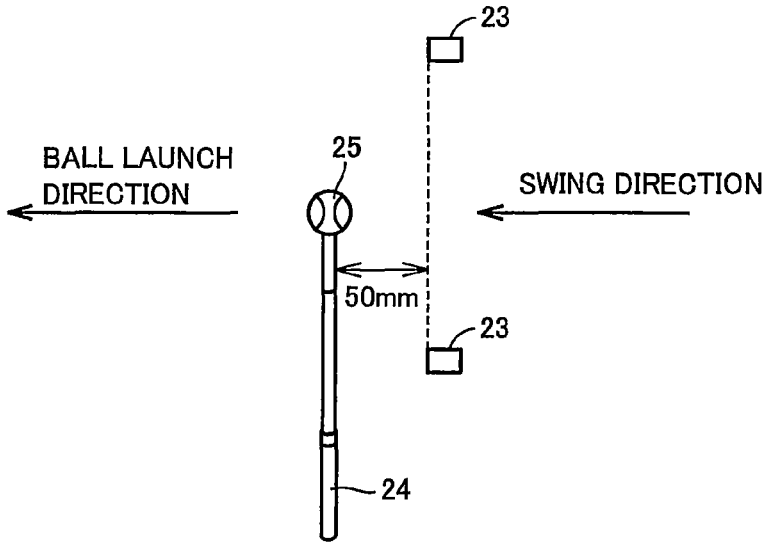
FIG. 3B is a view showing the positional relation between optical sensors and a tee included in the swing speed measurement device in accordance with the present embodiment.

As shown in FIG. 3A, swing speed measurement device 20 in accordance with the present embodiment includes a post 21, a sensor attachment portion 22, optical sensors 23, and tee 24. Swing speed measurement device 20 can obtain a swing speed by calculating a time taken when the bat passes between two rays emitted by optical sensors 23. It is noted that optical sensors 23 are arranged in the vicinity of tee 24 in order to calculate a swing speed immediately before a hitting position for hitting a ball 25. More specifically, as shown in FIG. 3B, for example, tee 24 is arranged such that a horizontal distance between optical sensors 23 and tee 24 is about 50 mm. It is noted that swing speed measurement device 20 is implemented with a known device. For example, swing speed measurement device 20 is "Speed Checker" manufactured by Miyamae Co. Ltd.

When the batter swings the bat at ball 25 arranged on tee 24, the hitting position for hitting ball 25 on the bat is measured based on a hit trace left when ball 25 is hit by the bat. It is noted that a color spray or the like is applied to the bat to allow a measurer to confirm the hit trace. Measurement of the hitting position is not limited to the above method, as long as the measurer can confirm the hit trace. For example, the hitting position may be measured based on a hit trace left when a painted ball is hit by a bat. Further, a configuration of applying a material which exhibits reversible piezochromism to a bat to confirm a hit trace may be used, considering cost and convenience.

Further, swing speed measurement device 20 measures and calculates the swing speed at the hitting position immediately before ball 25 is hit by the bat. A calculation result of the swing speed is displayed, for example, on a display unit not shown. It is noted that a protective net preventing ball 25 from flying out may be placed around swing speed measurement device 20.

Bat selection device 10 receives an input of information indicative of the swing speed and the hitting position measured as described above, through input device 120. Bat selection device 10 stores the swing parameter value for each of the three bats in memory 110 in a transitory or non-volatile manner.

(Estimation of Swing Parameter Value Specific to Batter)

Next, bat selection device 10 estimates a swing parameter value relevant to the swing of the batter, for each of the nine bats prepared beforehand, based on the swing parameter values of the three bats whose inputs have been received. Hereinafter, a description will be given of a case where bat selection device 10 estimates a hitting position for hitting an object on a bat, and a swing speed at the hitting position immediately before the object is hit by the bat, as the swing parameter value.

(Estimation of Hitting Position)

First, an estimation method by which bat selection device 10 estimates, for each of the nine bats, a hitting position for hitting ball 25 on the bat will be described. For each of the three swung bats, bat selection device 10 calculates a ratio of a length from one end of the bat to the hitting position to a total length of the bat (hereinafter also referred to as a "hitting position ratio"). Subsequently, bat selection device 10 calculates an average value of the hitting position ratios of the three swung bats. Then, bat selection device 10 estimates a hitting position on each of the nine bats, based on the calculated average value of the hitting position ratios and a total length of each of the nine bats. The reason why such estimation is possible will be described below with reference to FIGS. 4 and 5.

First, the hitting position ratio described above will be specifically described with reference to FIG. 4.

Figure 4:
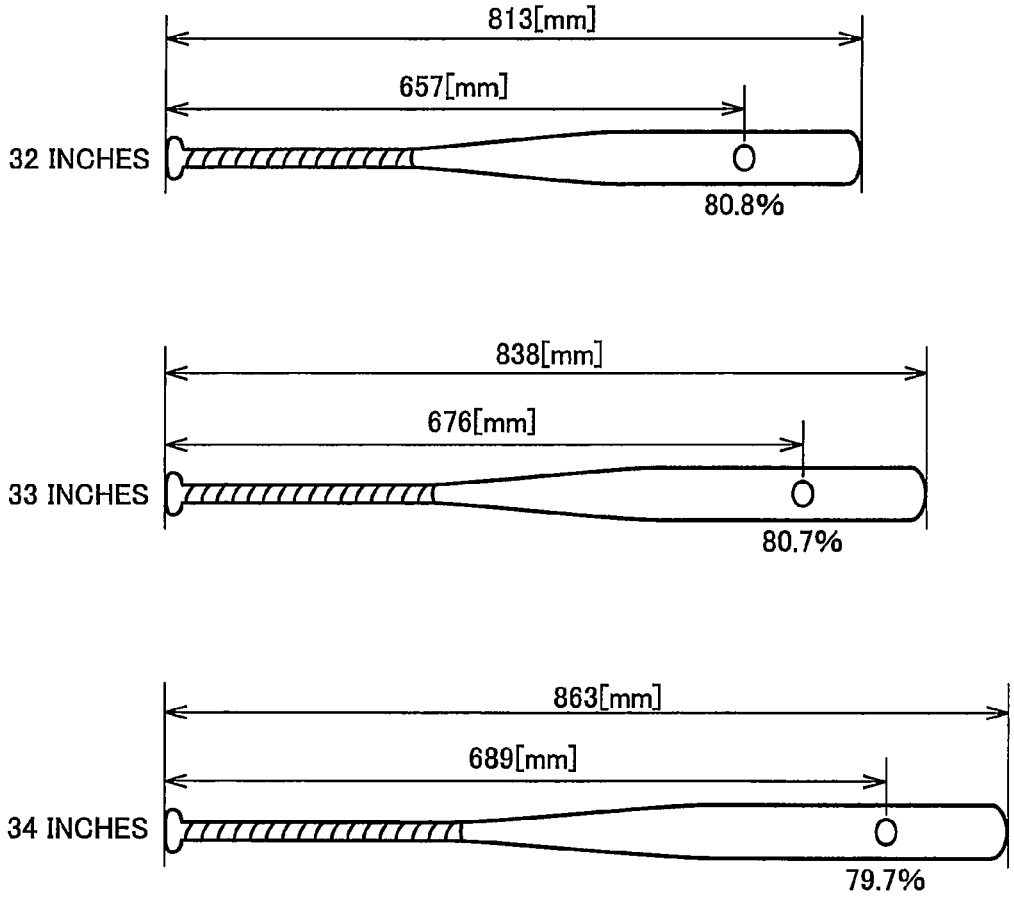
FIG. 4 is a view for illustrating a hitting position ratio in accordance with the present embodiment.

FIG. 4 shows measurement results of a hitting position and a hitting position ratio in each of bats of 32 inches to 34 inches, for one softball player. It is noted that the measurement results of the hitting position and the hitting position ratio shown in FIG. 4 are average values obtained when the softball player has swung each bat three times.

Referring to FIG. 4, it can be seen that, when the softball player swung the bat of 32 inches (total length: 813 mm), the softball player hit a ball at a position 657 mm from one end of the bat on the grip side. Thus, the hitting position ratio in the bat of 32 inches for the softball player is 80.8%. Similarly, the hitting position ratios in the bat of 33 inches and the bat of 34 inches for the softball player are 80.7% and 79.7%, respectively. Therefore, it can be found that, for the softball player, the hitting position ratios exhibit a substantially identical value irrespective of the lengths of the bats.

Next, results of performing measurement identical to that described in FIG. 4 on 30 softball players will be described with reference to FIG. 5.

Figure 5:
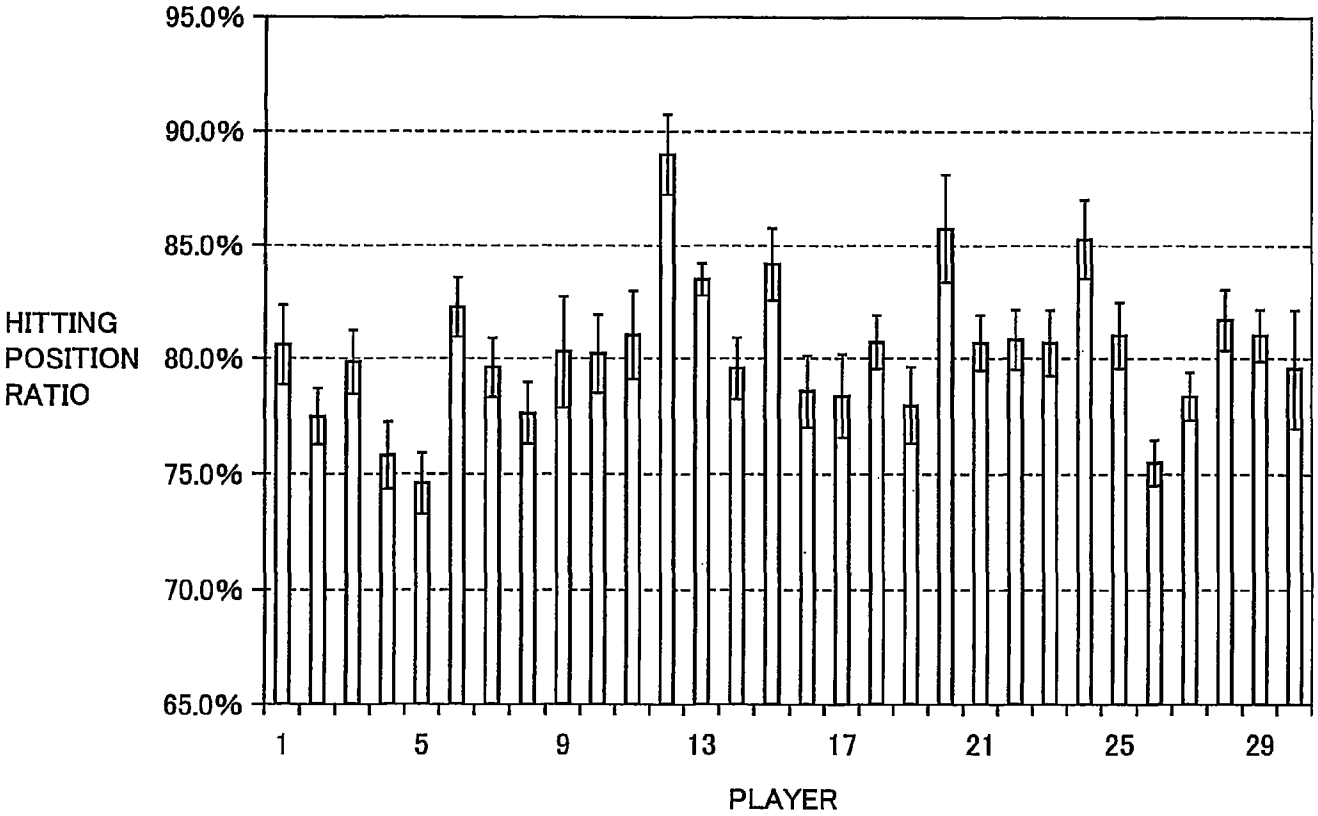
FIG. 5 is a view showing the hitting position ratio for each of a plurality of softball players.

In FIG. 5, each hitting position ratio indicated by a bar chart shows an average value of hitting position ratios in three bats of 32 inches, three bats of 33 inches, and three bats of 34 inches, that is, in a total of nine bats, for each player. Further, a standard deviation is indicated by an error bar, as an error range of hitting position ratios in three bats.

As is clear from FIG. 5, it can be seen that, although the hitting position ratio differs depending on the player, the hitting position ratio of each player has a small error range. Thus, it is estimated that the hitting position ratio is specific to each player irrespective of the lengths of the bats. For example, it can be said that player 5, having the lowest hitting position ratio among the 30 players, tends to hit a ball at a position closest to the grip side of a bat. In contrast, it can be said that player 12, having the highest hitting position ratio among the 30 players, tends to hit a ball at a position closest to the head side of a bat.

Consequently, bat selection device 10 calculates the hitting position ratio specific to the batter based on the three swung bats, multiplies the total length of each of the nine bats prepared beforehand by the calculated hitting position ratio, and thereby estimates hitting positions on the nine bats.

(Estimation of Swing Speed)

Next, an estimation method by which bat selection device 10 estimates a bat swing speed, for each of the nine bats prepared beforehand, will be described. For each of the three swung bats, bat selection device 10 converts the swing speed at the hitting position into an angular velocity about a grip end portion. Bat selection device 10 obtains a relational expression (correlation) between the moment of inertia and the angular velocity. Bat selection device 10 estimates a swing speed of the corresponding batter, for each of the nine bats, based on the obtained relational expression and the moments of inertia of the nine bats. It is noted that it is generally known that the swing speed of a batter decreases with an increase in the moment of inertia of a bat. However, since how the swing speed decreases varies depending on the batter, it is necessary to obtain the relational expression between the moment of inertia and the angular velocity for each batter. The estimation method will be described below with reference to FIG. 6.

The relation between the moment of inertia and the angular velocity about the grip end portion immediately before hitting of a bat in accordance with the present embodiment will be described with reference to FIG. 6. Considering the difference in bat length, bat selection device 10 converts a swing speed V at a measured hitting position into an angular velocity ω about the grip end portion (it is noted that, in the description below, the angular velocity about the grip end portion will also be referred to simply as an "angular velocity"). More specifically, bat selection device 10 converts swing speed V into angular velocity ω as $\omega=V/d$, where d is a distance from one end on the grip side to the hitting position. By obtaining a relational expression between converted angular velocity ω and a moment of inertia I ($\omega=a\times I+b$, where a is a slope and b is an intercept), bat selection device 10 can estimate the swing speed more accurately. More specifically, when an estimated swing speed is indicated as Vx, and an estimated hitting position estimated by the above method is indicated as dx, estimated swing speed Vx is calculated as $Vx=dx\times\omega$.

Figure 6:
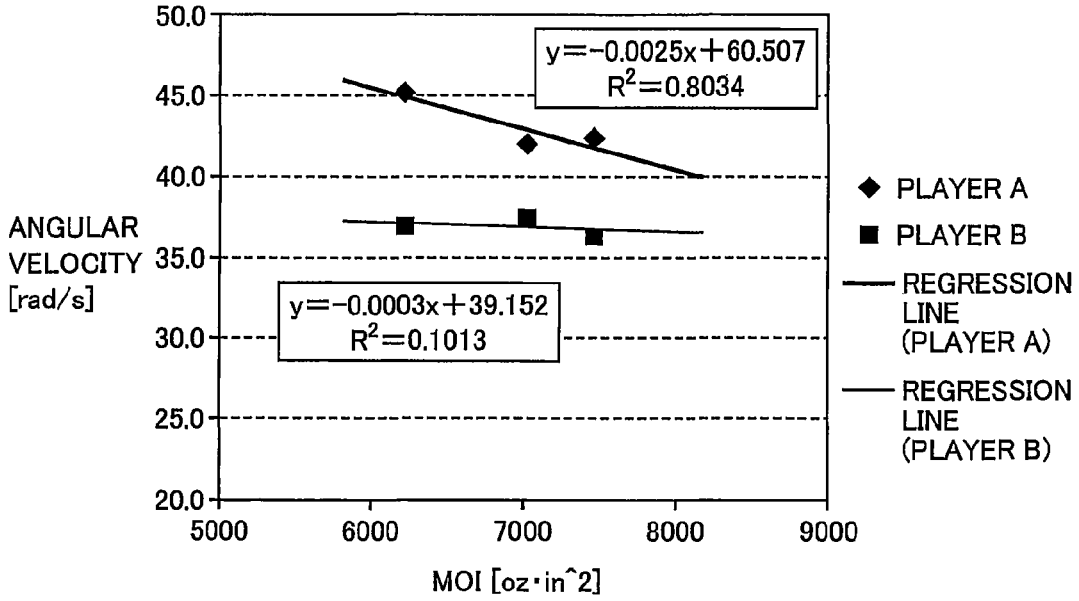
FIG. 6 is a view showing the relation between the moment of inertia and the angular velocity about a grip end portion immediately before hitting of a bat in accordance with the present embodiment.

As shown in FIG. 6, it can be seen that, for both player A and player B, the angular velocity decreases with an increase in the moment of inertia of the bat. However, it can be seen that the swing speed of player B is less influenced by the moment of inertia than that of player A. The relational expression (regression expression) between the moment of inertia and the angular velocity is obtained from the graph of FIG. 6.

Consequently, bat selection device 10 can estimate the swing speed of the batter, for each of the nine bats, based on the obtained relational expression (regression expression) and the moments of inertia of the nine bats.

(Calculation of Ball Launch Speed)

Next, bat selection device 10 calculates a speed of a ball hit by a bat immediately after hitting (i.e., a ball launch speed) based on a hitting position and a swing speed at the hitting position. More specifically, bat selection device 10 first calculates a reduced mass of the bat at the hitting position, based on a mathematical expression as shown in FIG. 7.

The reduced mass of the bat used for analysis by bat selection device 10 in accordance with the present embodiment will be described with reference to FIG. 7.

As shown in FIG. 7, a reduced mass M is obtained from a bat mass $m_1$, a distance r from a position of the center of gravity of the bat to the hitting position, and a moment of inertia leg about the center of gravity of the bat. Here, bat mass $m_1$, the position of the center of gravity of the bat, and moment of inertia leg about the center of gravity of the bat are specification information specific to each bat. Therefore, bat selection device 10 can calculate reduced mass M by calculating the hitting position by the above method.

Next, bat selection device 10 calculates the ball launch speed based on a mathematical expression as shown in FIG. 8.

The ball launch speed used for analysis by bat selection device 10 in accordance with the present embodiment will be described with reference to FIG. 8.

As shown in FIG. 8, a ball launch speed Vout is calculated from reduced mass M, a coefficient of restitution (COR) of the bat, a ball mass $m_2$, a swing speed Vs, and a pitching speed Vin. Here, reduced mass M is calculated by a method as described in FIG. 7. Further, ball mass $m_2$ is specification information specific to each ball, and the coefficient of restitution (COR) of the bat is specification information specific to each bat. Furthermore, in this example, pitching speed Vin is 0 because the batter performs tee batting. Therefore, bat selection device 10 can calculate ball launch speeds Vout for all of the nine prepared bats, by calculating the swing speeds by the above method.

It is noted that an actual pitching speed or an assumed pitching speed may be substituted as pitching speed Vin, to suit the ability of the batter.

It is noted that the accuracy of calculating ball launch speed Vout is enhanced by using a COR measurement value in a longitudinal direction of the bat as the coefficient of restitution (COR) of the bat. The COR is measured to comply with, for example, the ASTM (American Society of Testing and Materials) Standard No. F2219.

(Selection of Bat and Display of Result)

Next, bat selection device 10 selects a bat having the maximum calculated ball launch speed as a bat most suitable for the batter, from the nine prepared bats. Then, bat selection device 10 causes display 130 to display information about the selected bat (bat information, ball launch speed, and the like).

Figure 9:
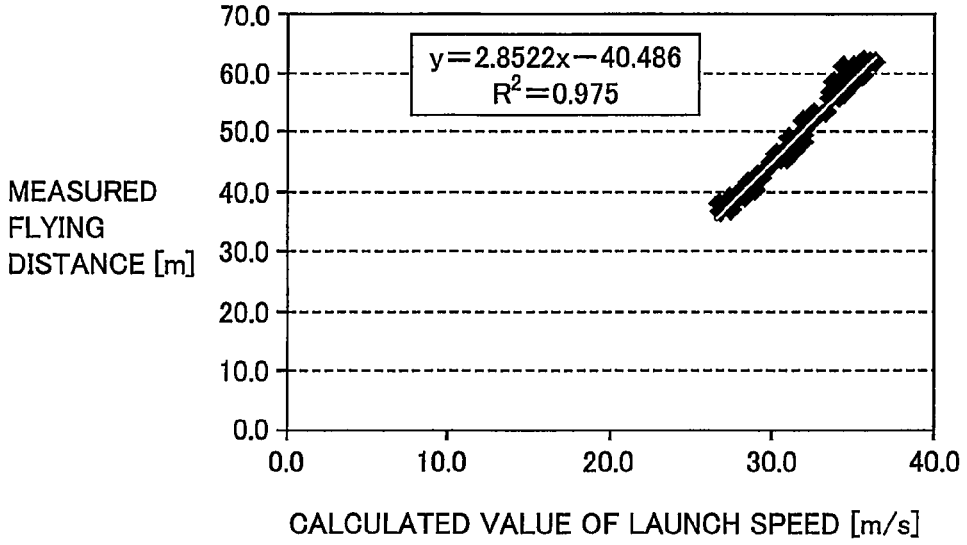
FIG. 9 is a view showing the relation between a calculated value of the ball launch speed and a measured flying distance of a ball in accordance with the present embodiment.

The relation between a calculated value of the ball launch speed and a measured flying distance of a ball in accordance with the present embodiment will be described with reference to FIG. 9. As shown in FIG. 9, ball launch speed Vout calculated by bat selection device 10 also has a considerably high correlation with the measured value of the ball flying distance. Bat selection device 10 may cause display 130 to display the ball flying distance substituted based on the ball launch speed.

<Functional Configuration>

Next, a functional configuration for implementing bat selection device 10 in accordance with the present embodiment as described above will be described with reference to FIG. 10.

Figure 10:
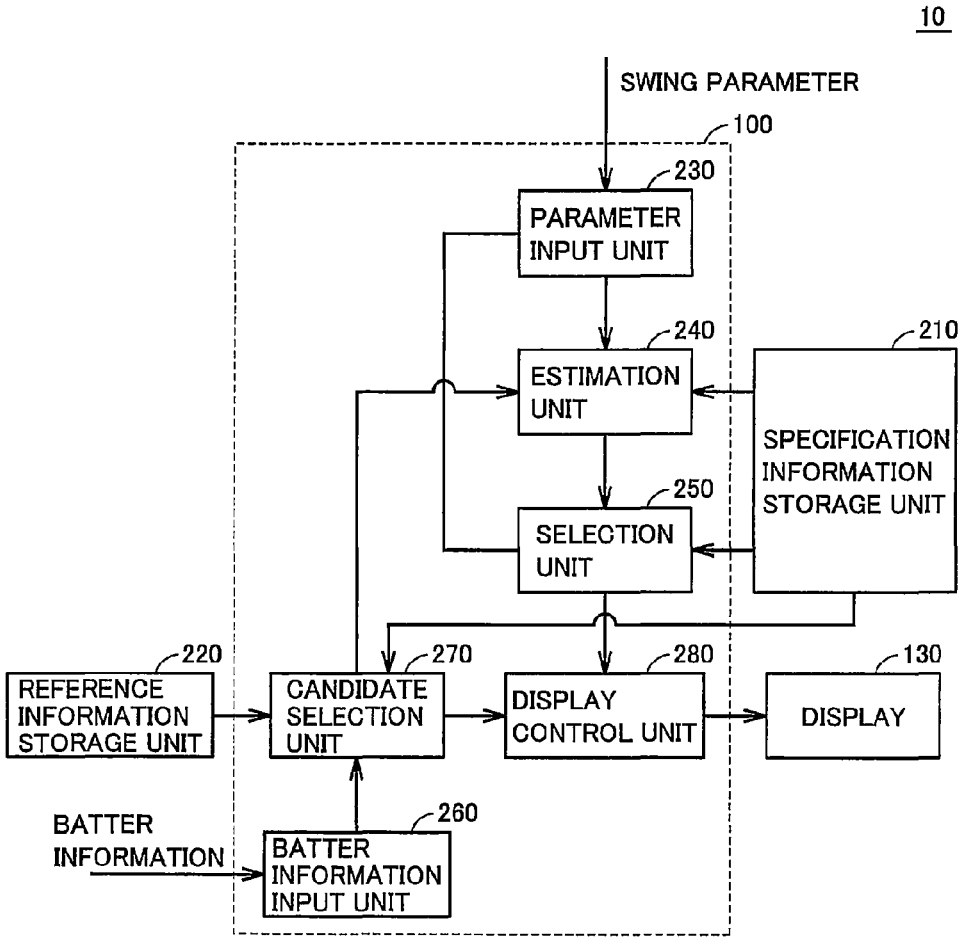
FIG. 10 is a functional block diagram of the bat selection device in accordance with the present embodiment.

As shown in FIG. 10, bat selection device 10 includes a specification information storage unit 210, a reference information storage unit 220, a parameter input unit 230, an estimation unit 240, a selection unit 250, a batter information input unit 260, a candidate selection unit 270, and a display control unit 280, as a main functional configuration. Basically, parameter input unit 230, estimation unit 240, selection unit 250, batter information input unit 260, candidate selection unit 270, and display control unit 280 are implemented by CPU 100 of bat selection device 10 executing a program stored in memory 110, providing commands to the components of bat selection device 10, and the like. That is, CPU 100 serves as a control unit controlling an entire operation of bat selection device 10. Further, specification information storage unit 210 and reference information storage unit 220 are implemented with memory 110. It is noted that the functional configuration may be partially or entirely implemented with hardware.

Specification information storage unit 210 stores specification information (weight, length, the moment of inertia, and the like) of each of a plurality of bats prepared beforehand. Reference information storage unit 220 stores batter information including at least one of age and physical characteristics of a batter, and selection reference information for selecting bats to be swung by the batter, in a manner associated with each other. The physical characteristics of the batter include, for example, the body height, the body weight, and the like of the batter.

Parameter input unit 230 receives an input of a swing parameter value relevant to swing of the batter, for each of at least two or more bats having moments of inertia different from one another swung by the batter at an object, of the plurality of bats prepared beforehand. More specifically, parameter input unit 230 receives the input of each swing parameter value through input device 120. It is noted that parameter input unit 230 may be configured to receive the input of each swing parameter value from an external device through communication interface 140. For example, the external device is swing speed measurement device 20. Parameter input unit 230 sends the swing parameter values whose inputs have been received, to estimation unit 240 and selection unit 250. Further, parameter input unit 230 may store the swing parameter values whose inputs have been received, in memory 110. It is noted that the swing parameter value includes a hitting position for hitting the object on the bat, and a swing speed at the hitting position immediately before the object is hit by the bat.

Estimation unit 240 estimates a swing parameter value corresponding to each of the plurality of bats, based on each swing parameter value received by parameter input unit 230. More specifically, estimation unit 240 calculates, for each of the at least two or more bats which have been swung, a ratio of a length from one end of the bat to the hitting position to a total length of the bat, and estimates a hitting position corresponding to each of the plurality of bats based on the calculated ratio and total lengths of the plurality of bats. Further specifically, estimation unit 240 estimates, for each of the plurality of bats, the hitting position for hitting the object on the bat, by multiplying the total length of each of the plurality of bats by the calculated ratio.

Further, estimation unit 240 converts, for each of the at least two or more bats which have been swung, the swing speed into an angular velocity about a grip end portion. Estimation unit 240 obtains a relational expression between the moment of inertia and the angular velocity, and estimates a swing speed corresponding to each of the plurality of bats based on the obtained relational expression and the moments of inertia of the plurality of bats. Estimation unit 240 sends the estimated swing parameter values to selection unit 250. It is noted that estimation unit 240 can learn the specifications (total length, the moment of inertia) of each bat by referring to specification information storage unit 210.

Selection unit 250 calculates an index parameter value serving as an index for selecting a bat suitable for the batter who has swung the bats from the plurality of bats, for each of the plurality of bats, based on the swing parameter value corresponding to the bat estimated by estimation unit 240. The index parameter value includes a ball launch speed of the object hit by the bat immediately after hitting, or a flying distance of a ball. The flying distance of the ball is calculated based on the ball launch speed. Selection unit 250 selects a bat suitable for the batter from the plurality of bats prepared beforehand, based on the calculated index parameter values. More specifically, selection unit 250 calculates, for each of the plurality of bats, the ball launch speed of the object hit by the bat immediately after hitting, based on the hitting position and the swing speed corresponding to the bat. Then, selection unit 250 selects a bat having the maximum calculated speed as the bat suitable for the batter, from the plurality of bats. When selection unit 250 calculates the flying distance of the ball as the index parameter value, selection unit 250 selects a bat having the maximum flying distance as the bat suitable for the batter, from the plurality of bats.

Batter information input unit 260 receives an input of the batter information through input device 120. Candidate selection unit 270 selects the at least two or more bats having the moments of inertia different from one another as candidates to be swung by the batter, from the plurality of bats, based on the batter information received by batter information input unit 260 and the selection reference information. Preferably, candidate selection unit 270 selects the bats having bat lengths (or weights) and moments of inertia different from one another. For example, when the batter is under 13 years old, candidate selection unit 270 selects bats having moments of inertia different from one another from bats of 31 inches to 33 inches, and when the batter is 13 years old or older, candidate selection unit 270 selects bats having moments of inertia different from one another from bats of 32 inches to 34 inches, based on the selection reference information. It is noted that, when the selection reference information is associated with the physical characteristics such as the body height of the batter, candidate selection unit 270 may select bats based on the physical characteristics of the batter whose inputs have been received.

Display control unit 280 causes display 130 to display the bat selected by selection unit 250. Further, display control unit 280 may cause display 130 to display a calculation result of the launch speed of the ball to be hit by the selected bat.

<Processing Procedure>

Figure 13:
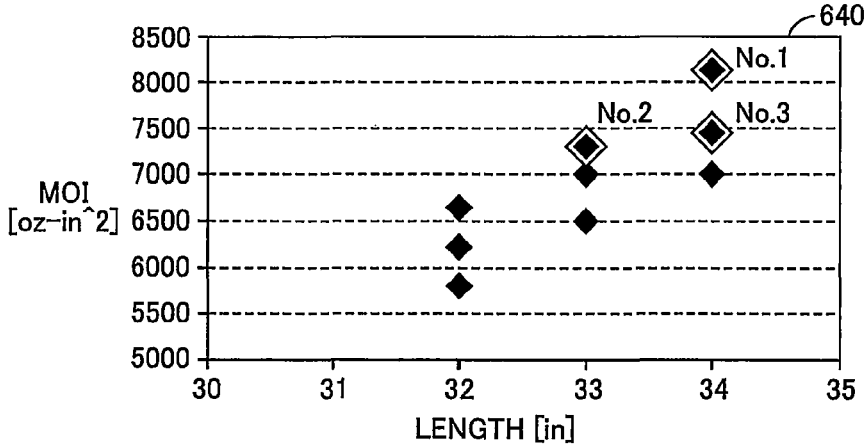
FIG. 13 is another user interface screen provided by the bat selection device in accordance with the present embodiment.

Next, a processing procedure of bat selection device 10 in accordance with the present embodiment will be described with reference to FIGS. 11, 12, and 13.

The processing procedure of bat selection device 10 in accordance with the present embodiment will be described with reference to FIG. 11. The steps described below are implemented by CPU 100 executing a program stored in memory 110. It is noted that memory 110 stores specification information of a plurality of bats prepared beforehand.

Figure 11:
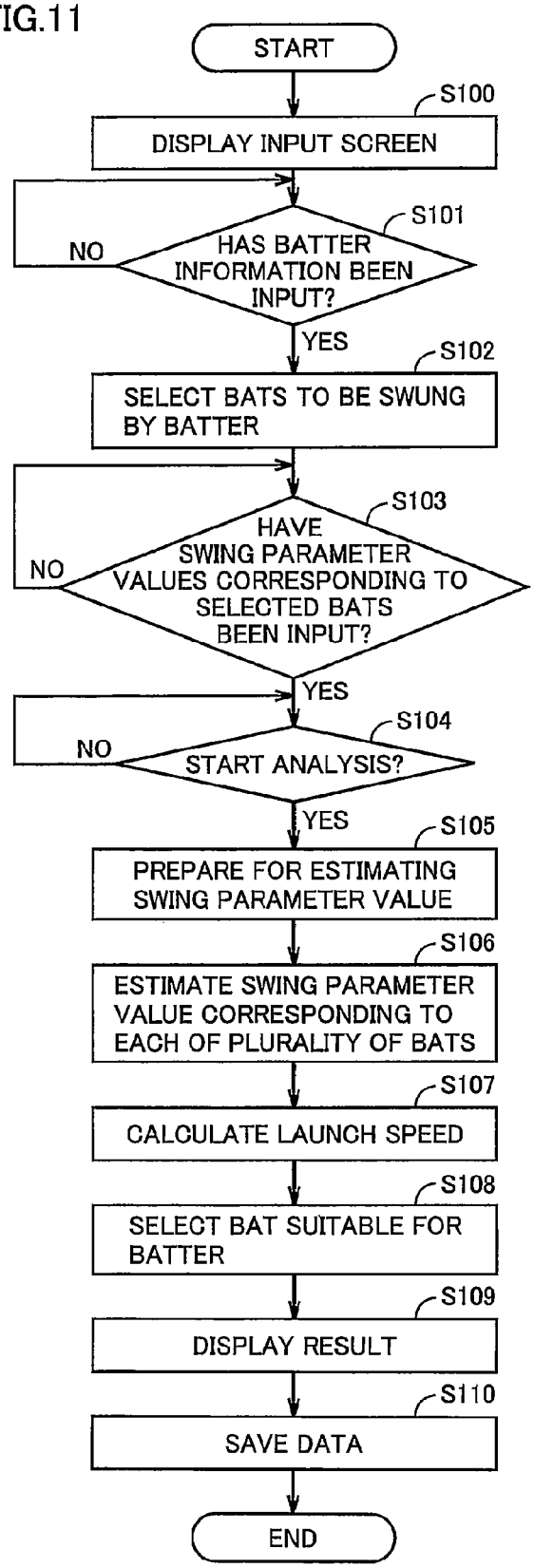
FIG. 11 is a flowchart showing a processing procedure of the bat selection device in accordance with the present embodiment.

As shown in FIG. 11, CPU 100 causes display 130 to display an input screen (a user interface screen 500) for receiving an input of necessary information (step S100).

User interface screen 500 provided by bat selection device 10 in accordance with the present embodiment will be described with reference to FIG. 12. As shown in FIG. 12, user interface screen 500 includes a display region 510 displaying batter information, a display region 520 displaying bat information about bats to be swung by a batter, a display region 530 displaying swing parameter values relevant to swing, a display region 540 displaying pitching speeds, and a button 550 for starting analysis. It is noted that FIG. 12 shows an exemplary screen on which corresponding information is already displayed in each of display regions 510 to 540.

Referring to FIG. 11 again, CPU 100 determines whether or not an input of the batter information has been received through input device 120 (step S101). When CPU 100 determines that an input of the batter information has not been received (NO in step S101), CPU 100 repeats the processing in step S101.

On the other hand, when CPU 100 determines that an input of the batter information has been received (YES in step S101), CPU 100 proceeds to the processing in step S102. On this occasion, CPU 100 causes display region 510 to display the batter information (in this example, the batter's name, age, and the name of his/her team) whose input has been received.

CPU 100 selects the bats to be swung by the batter, from the prepared plurality of bats whose specification information is stored in memory 110 (step S102). More specifically, CPU 100 selects at least two or more bats having moments of inertia different from one another, from the prepared plurality of bats, based on the input age of the batter and selection reference information associated with age. On this occasion, CPU 100 causes display region 520 to display the bat information about the selected bats (in this example, bat information about bats of 32 inches, 33 inches, and 34 inches). It is noted that numeral (−9) included in the bat information indicates the weight of each bat, and for example, in the case of the bat of 32 inches, it indicates that the bat has a weight of 23 ounces.

CPU 100 determines whether or not an input of a swing parameter value relevant to swing of the batter has been received, for each of the selected bats (step S103). More specifically, CPU 100 determines whether or not an input of the swing parameter value corresponding to each of the selected bats has been received through-input device 120. Alternatively, CPU 100 determines whether or not an input of the swing parameter value corresponding to each of the selected bats has been received (i.e., whether or not the swing parameter value has been received) from an external device through communication interface 140.

When an input of the swing parameter value has not been received (NO in step S103), CPU 100 repeats the processing in step S103. On the other hand, when an input of the swing parameter value has been received (YES in step S103), CPU 100 proceeds to the processing in step S104. On this occasion, CPU 100 causes display region 530 to display the swing parameter value (swing speed and hitting position) corresponding to each of the selected bats.

CPU 100 determines whether or not to start analysis for selecting a bat suitable for the batter, based on an operation on bat selection device 10 (step S104). More specifically, CPU 100 determines whether or not an instruction to start analysis has been received through input device 120. For example, CPU 100 makes the determination based on whether or not button 550 indicating "Start analysis" has been selected. When analysis is not started (NO in step S104), CPU 100 repeats the processing in step S104. On the other hand, when analysis is started (YES in step S104), CPU 100 proceeds to the processing in step S105.

CPU 100 makes preparation for estimating a swing parameter value corresponding to each of the plurality of bats based on the swing parameter values corresponding to the selected bats (step S105). More specifically, CPU 100 calculates an average value of hitting position ratios based on the input hitting positions. Further, based on the swing speeds at the input hitting positions, CPU 100 converts the swing speeds into angular velocities, and obtains a relational expression (i.e., obtains a regression expression) between the moment of inertia and the angular velocity.

CPU 100 estimates the swing parameter value corresponding to each of the plurality of bats (step S106). More specifically, CPU 100 estimates a hitting position corresponding to each of the plurality of bats, based on the calculated average value of the hitting position ratios and the total length of each of the plurality of bats. Further, CPU 100 estimates a swing speed corresponding to each of the plurality of bats, based on the obtained relational expression between the moment of inertia and the angular velocity, and the moments of inertia of the plurality of bats.

Subsequently, CPU 100 calculates, for each of the plurality of bats, a launch speed of a ball hit by the bat, based on the hitting position and the swing speed corresponding to the bat (step S107). CPU 100 selects a bat having the maximum calculated ball launch speed as the bat suitable for the batter, from the plurality of bats (step S108).

Here, the calculated ball launch speed is calculated, assuming direct collision of an object and a bat (i.e., collision, in a state where, immediately before the bat hits the object, the direction in which the center of a circular tube of the bat moves is oriented to the center of the object). Actually, however, the probability of direct collision (i.e., meet ratio) is low for a so-called low swing-skill player such as a player with wide variations in swing speed during swing and hitting position, a player with a slow swing speed, and the like. When such a low swing-skill player swings a bat having a high MOI, a longer swing time or a lower meet ratio is expected. Thus, when the low swing-skill player swings a bat having a high MOI, CPU 100 may calculate the ball launch speed by correcting the value of coefficient of restitution COR in the mathematical expression shown in FIG. 8 to be smaller. For example, for a player who misses a ball when using a bat having a high MOI, CPU 100 may multiply the value of coefficient of restitution COR by 0 and output ball launch speed Vout as 0. Therefore, as the value correcting coefficient of restitution COR, a value from 0 to 1 is expected.

CPU 100 displays an output result (step S109). More specifically, CPU 100 displays a user interface screen 600 as shown in FIG. 13.

Another user interface screen provided by bat selection device 10 in accordance with the present embodiment will be described with reference to FIG. 13. As shown in FIG. 13, user interface screen 600 includes a display region 610 displaying information about a bat most suitable for the batter, a display region 620 displaying information about a second most suitable bat, a display region 630 displaying information about a third most suitable bat, and a graph 640 showing the relation between the length and the moment of inertia of the bats.

Referring to FIG. 11 again, CPU 100 saves data of the output result in memory 110 (step S110). Then, CPU 100 terminates the processing.

<Details of Calculation Procedures>

Details of calculation procedures through which bat selection device 10 in accordance with the present embodiment calculates a ball launch speed for each of a plurality of bats prepared beforehand, using specification information of the plurality of bats, will be described with reference to FIGS. 14 and 15.

The calculation procedures performed in bat selection device 10 in accordance with the present embodiment will be described with reference to FIG. 14. FIG. 15 is a view showing another example of the relation between the moment of inertia Sand the angular velocity of the bat in accordance with the present embodiment.

As shown in FIG. 14, memory 110 stores specification information of bats of No. 1 to No. 9. The specification information is prepared beforehand by, for example, store staff of a store selling bats, or the like (procedure A).

Bat selection device 10 selects bats to be swung by a batter (i.e., the bats of No. 2, No. 5, and No. 8) based on the batter's age and the like, and, as results obtained by having the batter swing each of the selected bats, receives inputs of a hitting position and a swing speed for each of the bats (procedure B).

Bat selection device 10 calculates a hitting position ratio for each of the bats, based on the hitting position and the total length corresponding to the bat, and converts the swing speed at the hitting position corresponding to the bat into an angular velocity (procedure C).

Figure 15:
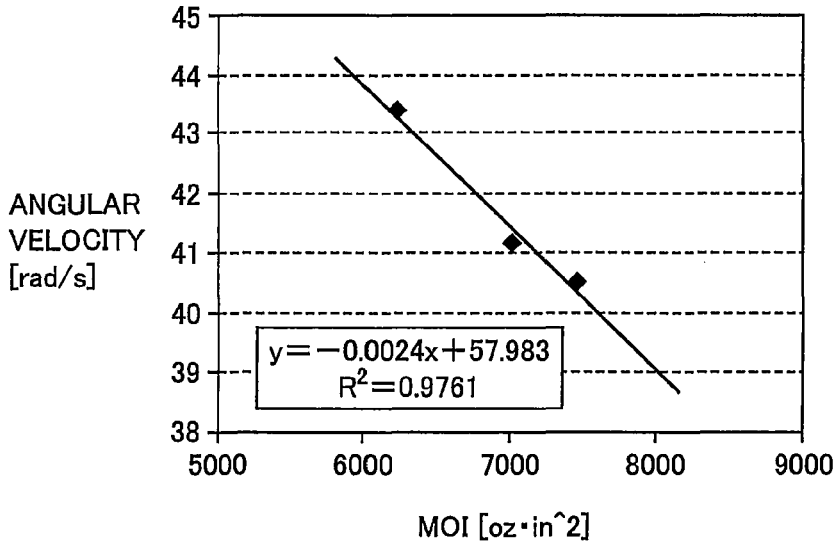
FIG. 15 is a view showing another example of the relation between the moment of inertia and the angular velocity about the grip end portion of the bat in accordance with the present embodiment.

Bat selection device 10 calculates an average value (82.9%) of the hitting position ratios of the bats, and obtains a regression expression between the moment of inertia and the angular velocity based on the relation between the moment of inertia and the angular velocity shown in FIG. 15 (procedure D).

Bat selection device 10 multiplies the total length of each of the nine bats, by the calculated average value of the hitting position ratios, to calculate an estimated hitting position for each of the bats. Further, bat selection device 10 calculates an estimated angular velocity for each of the nine bats based on the moment of inertia of each of the bats and the regression expression, and reconverts the estimated angular velocity into a swing speed at the hitting position to calculate an estimated swing speed (procedure E).

Bat selection device 10 substitutes the estimated hitting position into the expression shown in FIG. 7 to obtain reduced mass M. Then, bat selection device 10 substitutes reduced mass M and the estimated swing speed into the expression shown in FIG. 8 to calculate a ball launch speed for each of the bats (procedure F).

<Another Aspect>

The above description has been given of the case where bat selection device 10 estimates the swing parameter value corresponding to each of the plurality of bats prepared beforehand, based on the swing parameter values whose inputs have been received. Here, as another aspect, a case where bat selection device 10 estimates a swing parameter value corresponding to each of remaining bats of the plurality of bats other than the at least two or more bats which have been swung, based on the swing parameter values whose inputs have been received will be described. It is noted that, since bat selection device 10 in the other aspect has a hardware configuration identical to that shown in FIG. 1, the detailed description thereof will not be repeated.

(Functional Configuration)

A functional configuration of bat selection device 10 in the other aspect will be described with reference to FIG. 10. It is noted that, since specification information storage unit 210, reference information storage unit 220, parameter input unit 230, batter information input unit 260, candidate selection unit 270, and display control unit 280 are identical to those in the functional configuration described above, the detailed description thereof will not be repeated.

Estimation unit 240 estimates a swing parameter value corresponding to each of remaining bats of the plurality of bats other than the at least two or more bats which have been swung, based on each swing parameter value received by parameter input unit 230. More specifically, estimation unit 240 calculates, for each of the at least two or more bats which have been swung, a ratio of a length from one end of the bat to the hitting position to a total length of the bat, and estimates a hitting position corresponding to each of the remaining bats based on the calculated ratio and total lengths of the remaining bats. Further specifically, estimation unit 240 estimates, for each of the remaining bats, the hitting position for hitting the object on the bat, by multiplying the total length of each of the remaining bats by the calculated ratio.

Further, estimation unit 240 converts, for each of the at least two or more bats which have been swung, the swing speed into an angular velocity about a grip end portion. Estimation unit 240 obtains a relational expression between the moment of inertia and the angular velocity, and estimates a swing speed corresponding to each of the remaining bats, based on the obtained relational expression and the moments of inertia of the remaining bats. Estimation unit 240 sends the estimated swing parameter values to selection unit 250. It is noted that estimation unit 240 can learn the specifications (total length, the moment of inertia) of each bat by referring to specification information storage unit 210.

Selection unit 250 calculates an index parameter value indicative of an index for selecting a bat suitable for the batter who has swung the bats from the plurality of bats, for each of the plurality of bats, based on the received estimated swing parameter values and the swing parameter values estimated by estimation unit 240. Selection unit 250 selects a bat suitable for the batter from the plurality of bats, based on the calculated index parameter values. More specifically, selection unit 250 calculates, for each of the at least two or more bats which have been swung, a ball launch speed of an object hit by the bat immediately after hitting, based on the hitting position and the swing speed corresponding to the bat received by parameter input unit 230. Further, selection unit 250 calculates a ball launch speed for each of the remaining bats, based on the hitting position and the swing speed corresponding to the bat estimated by estimation unit 240. Then, selection unit 250 selects a bat having the maximum calculated ball launch speed as the bat suitable for the batter, from the plurality of bats. When selection unit 250 calculates the flying distance of the ball as the index parameter value, selection unit 250 selects a bat having the maximum flying distance as the bat suitable for the batter, from the plurality of bats.

(Processing Procedure)

Next, a processing procedure of bat selection device 10 in the other aspect will be described with reference to FIG. 16.

The steps described below are implemented by CPU 100 executing a program stored in memory 110. It is noted that memory 110 stores specification information of a plurality of bats prepared beforehand.

Figure 16:
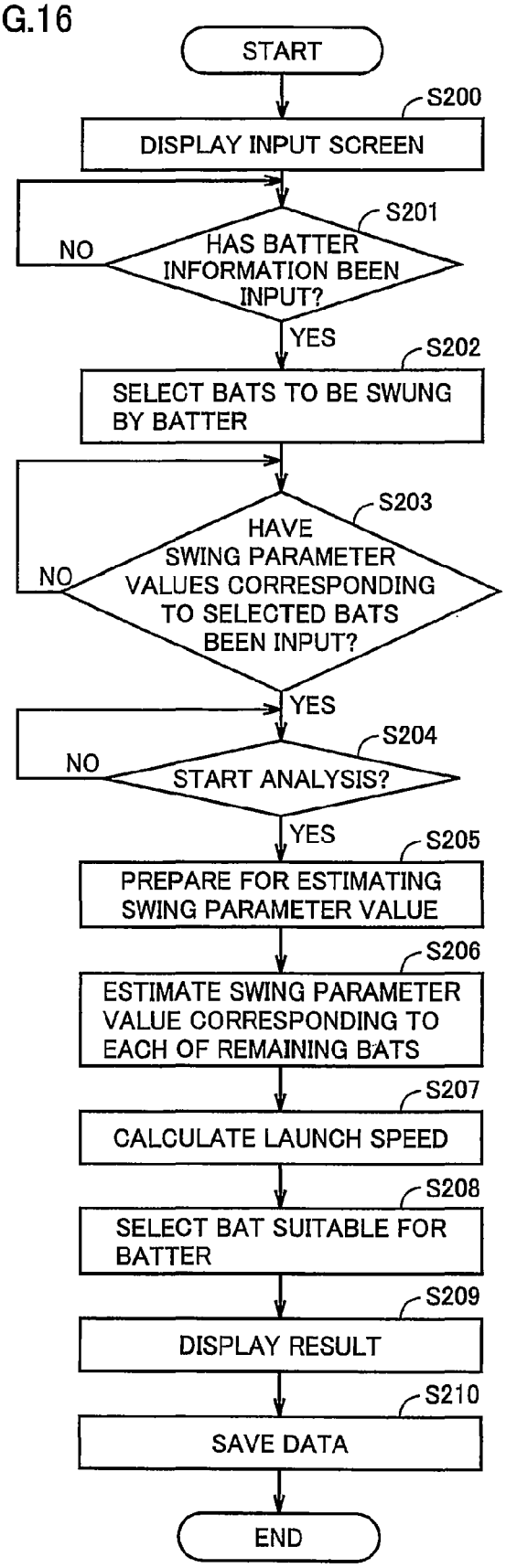
FIG. 16 is a flowchart showing a processing procedure of the bat selection device in another aspect.

Since processes in steps S200 to S205 in FIG. 16 are identical to those in steps S100 to S105 in FIG. 11, respectively, the detailed description thereof will not be repeated.

CPU 100 makes preparation for estimating a swing parameter value corresponding to each of the remaining bats (step S205), and estimates the swing parameter value corresponding to each of the remaining bats (step S206). More specifically, CPU 100 estimates a hitting position corresponding to each of the remaining bats, based on the average value of the hitting position ratios and the total length of each of the remaining bats. Further, CPU 100 estimates a swing speed corresponding to each of the remaining bats, based on the obtained relational expression between the moment of inertia and the angular velocity, and the moments of inertia of the remaining bats.

CPU 100 calculates, for each of the plurality of bats, a launch speed of a ball hit by the bat (step S207). More specifically, CPU 100 calculates, for each of the at least two or more bats which have been swung, a launch speed of a ball hit by the bat, based on the hitting position and the swing speed whose inputs have been received. Further, CPU 100 calculates a ball launch speed for each of the remaining bats, based on the estimated hitting position and swing speed. That is, for each of the bats which have been swung, CPU 100 calculates the ball launch speed based on the measured swing parameter value, and for each of the remaining bats, CPU 100 calculates the ball launch speed based on the estimated swing parameter value.

Since processes in steps S208 to S210 are identical to those in steps S108 to S110 in FIG. 11, respectively, the detailed description thereof will not be repeated.

(Details of Calculation Procedures)

Next, specific calculation procedures through which bat selection device 10 in the other aspect calculates a ball launch speed for each of a plurality of bats prepared beforehand, using specification information of the plurality of bats, will be described with reference to FIG. 17.

The calculation procedures performed by bat selection device 10 in the other aspect will be described with reference to FIG. 17. It is noted that, since calculation procedures (procedure A) to (procedure D) in FIG. 17 are identical to the calculation procedures (procedure A) to (procedure D) in FIG. 14, the detailed description thereof will not be repeated.

Bat selection device 10 multiplies the total length of each of the remaining six bats which have not been swung, by the average value of the hitting position ratios, to calculate an estimated hitting position for each of the six bats. Further, bat selection device 10 calculates an estimated angular velocity for each of the six bats based on the moment of inertia of each of the bats and the regression expression, and reconverts the estimated angular velocity into a swing speed at the hitting position to calculate an estimated swing speed (procedure E).

For each of the three bats which have been swung, bat selection device 10 substitutes the input (measured) hitting position and the input (measured) swing speed into the expressions shown in FIGS. 7 and 8, respectively, to calculate a ball launch speed corresponding to each bat. For each of the remaining six bats which have not been swung, bat selection device 10 substitutes the estimated hitting position and the estimated swing speed into the expressions shown in FIGS. 7 and 8, respectively, to calculate a ball launch speed corresponding to each bat (procedure F).

<Others>

When swing speed measurement device 20 has a communication interface for communicating with bat selection device 10 in the above description, swing speed measurement device 20 may be configured to transmit the measured swing speed to bat selection device 10. On this occasion, bat selection device 10 receives an input of information about the transmitted swing speed through communication interface 140.

Further, swing speed measurement device 20 may be configured to measure the hitting position described above. For example, swing speed measurement device 20 is provided with a high-speed camera, and is configured to be capable of imaging the bat hitting the ball. The high-speed camera is arranged immediately above tee 24, and is configured to be capable of imaging the moment immediately before the bat hits ball 25 arranged on tee 24 from above.

Furthermore, the swing speed measurement device is not limited to be configured as shown in FIGS. 3A and 3B described above, and may be configured to calculate the swing speed at the hitting position by converting it from a swing speed at a leading end of the bat. In this case, the swing speed measurement device measures the swing speed at the leading end of the bat, and converts the measurement result based on a distance from the leading end of the bat to the hitting position to calculate the swing speed at the hitting position. In addition, a removable sensor device (accelerometer and gyro sensor) may be attached to the grip end portion to calculate the swing speed based on an angular velocity measured by the sensor device. Alternatively, a removable sensor device may be attached to the back of a hand of a batter to calculate the swing speed based on an angular velocity measured by the sensor device. It is noted that, when it is assumed that the positional relation between the bat and the back of the hand is fixed during hitting, the angular velocity measured by the sensor device attached to the grip end portion is the same as the angular velocity measured by the sensor device attached to the back of the hand. In this case, the swing parameter value described above includes a hitting position for hitting a ball on the bat, and an angular velocity measured by the sensor device.

Specifically, bat selection device 10 (parameter input unit 230) receives inputs of the hitting position and the angular velocity corresponding to each of at least two or more (for example, three) swung bats.

Subsequently, bat selection device 10 (estimation unit 240) estimates a hitting position and a swing speed corresponding to each of a plurality of (for example, nine) bats prepared beforehand, based on each received hitting position and angular velocity. Specifically, bat selection device 10 (estimation unit 240) calculates a hitting position ratio specific to the batter based on the three swung bats, multiplies the total length of each of the nine bats by the calculated hitting position ratio, and thereby estimates hitting positions on the nine bats. Further, bat selection device 10 (estimation unit 240) obtains a relational expression between each received angular velocity and the moment of inertia (see FIG. 6), and estimates a swing speed corresponding to each of the nine bats based on the obtained relational expression and the moments of inertia of the nine bats. That is, since bat selection device 10 estimates the swing speed using the angular velocity measured directly by the sensor device and the estimated hitting position, processing for converting the swing speed into an angular velocity is not required, when compared with a case where the swing speed is measured.

Then, bat selection device 10 (selection unit 250) calculates an index parameter value (a ball launch speed or a flying distance), for each of the nine bats, based on the estimated hitting position on the bat and the estimated swing speed corresponding to the bat, and selects a bat suitable for the batter from the nine bats based on the calculated index parameter values.

(In Case where Hitting Position is Assumed)

Although the above embodiment has described the case of measuring a hitting position for hitting an object on a bat, the present invention is not limited thereto. For example, a ball launch speed may be calculated based on an assumption that the hitting position is a predetermined position on a bat, and a bat most suitable for a batter may be selected based on the calculated ball launch speed. First, validity of such a selection method will be described.

In the above description, it has been described that the hitting position ratio is specific to each player irrespective of the lengths of the bats (see FIG. 5). Here, a further description will be given on how the hitting position ratio influences a bat selected as a bat most suitable for a batter. Specifically, a description will be given on what change occurs in a bat selected as a bat most suitable for a batter in a case where a measured hitting position ratio is used and in a case where a predetermined assumed hitting position ratio is used. It is noted that, since the average value of the hitting position ratios of all the 30 players shown in FIG. 5 is 80.4%, assumed hitting position ratios are set to 75%, 80%, and 85% close to the average value.

Figure 18:
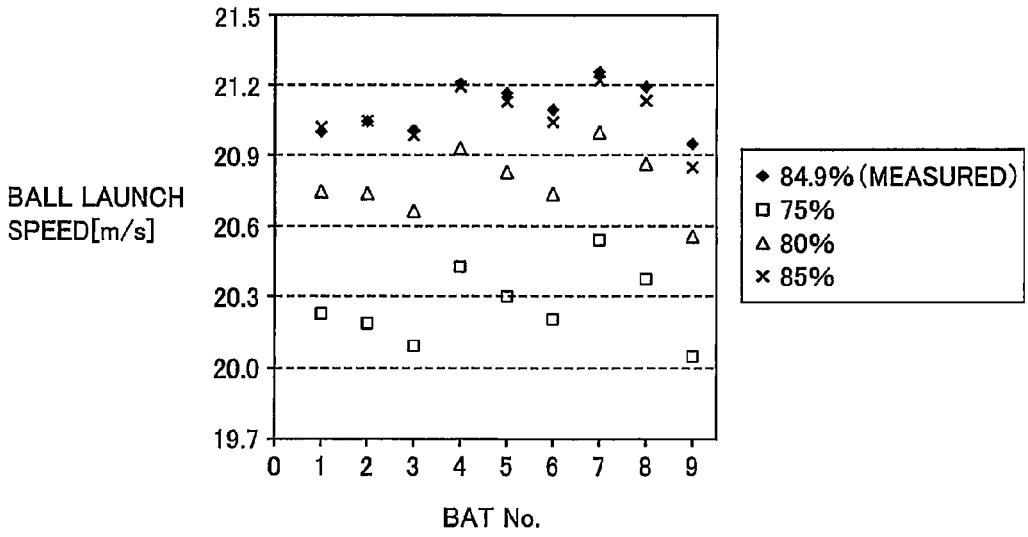
FIG. 18 is a view showing ball launch speeds obtained when a batter A used nine bats.
Figure 19:
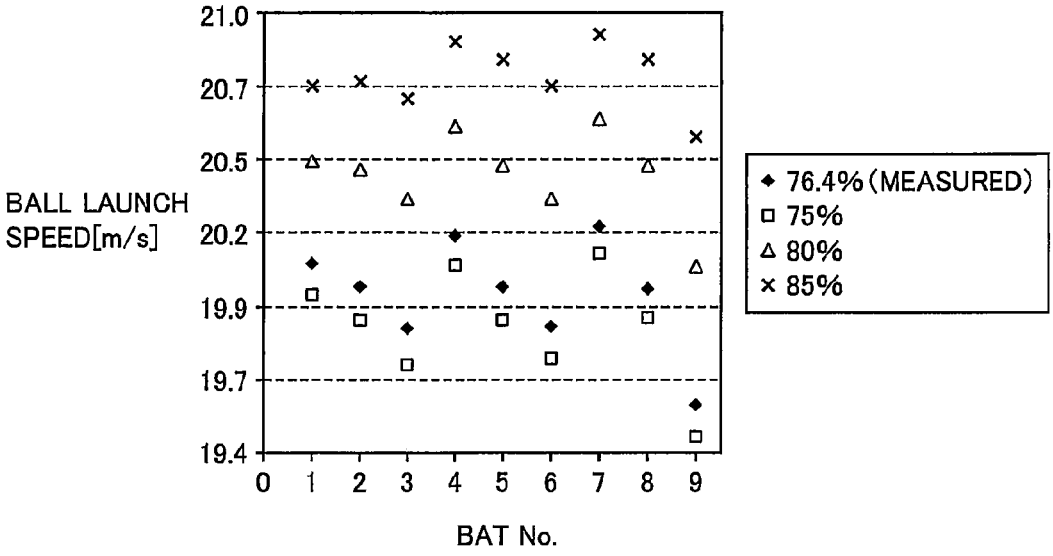
FIG. 19 is a view showing ball launch speeds obtained when a batter B used nine bats.
Figure 20:
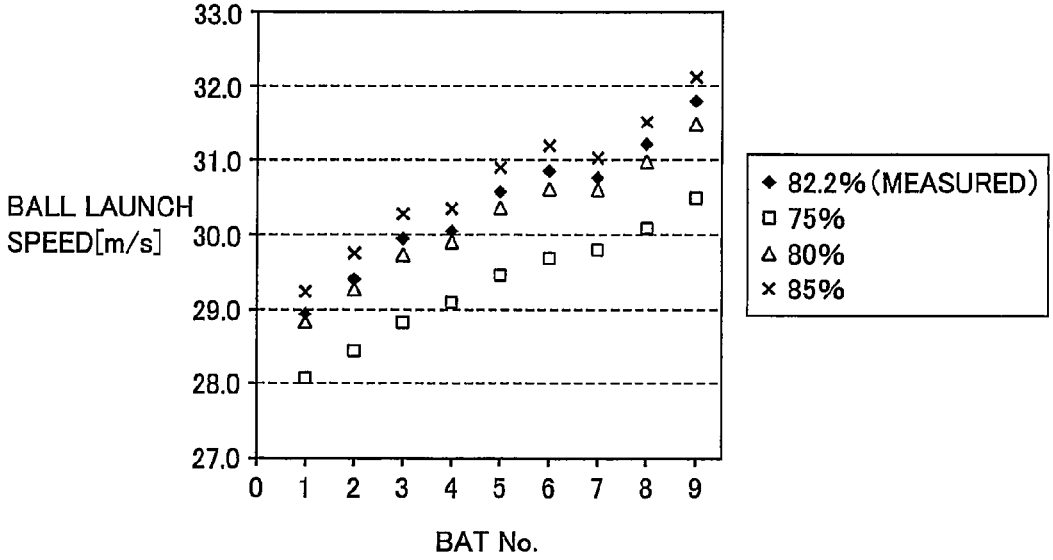
FIG. 20 is a view showing ball launch speeds obtained when a batter C used nine bats.

FIGS. 18 to 20 are views showing ball launch speeds obtained when batters A to C used nine bats, respectively. As shown in FIGS. 18 to 20, measured hitting position ratios of batters A to C are 84.9%, 76.4%, and 82.2%, respectively. It is noted that each measured hitting position ratio is calculated through procedures A to D shown in FIG. 14, and a ball launch speed corresponding to each bat is calculated through procedures E and F shown in FIG. 14 using each measured hitting position ratio.

Referring to FIG. 18, when ball launch speeds calculated from the measured hitting position ratio (84.9%) for the nine bats are compared with each other, the maximum ball launch speed is achieved when the bat of No. 7 was used. Therefore, the bat of No. 7 is selected as a bat most suitable for batter A.

Here, a case where a ball launch speed corresponding to each bat is calculated through procedures E and F shown in FIG. 14 based on an assumption that the hitting position ratio of batter A is 75% will be considered. The ball launch speed calculated based on the assumption that the hitting position ratio is 75% is lower than the ball launch speed calculated using the value of the measured hitting position ratio. However, since the maximum ball launch speed is achieved when the bat of No. 7 among the nine bats was used, the bat of No. 7 is selected as the bat most suitable for batter A also in this case.

Further, also in a case where it is assumed that the average hitting position ratio of batter A is 80% or 85%, the maximum ball launch speed is achieved when the bat of No. 7 among the nine bats was used, and thus the bat of No. 7 is selected as the bat most suitable for batter A.

Thus, it is found that, although the ball launch speed calculated based on the assumption that the hitting position ratio has a value different from a measured value (i.e., is 75%, 80%, or 85%) is different from the ball launch speed obtained from the measured value of the hitting position ratio, there is no change in the bat selected as the bat most suitable for batter A (i.e., the bat of No. 7 in any case).

Referring to FIG. 19, when ball launch speeds calculated from the measured hitting position ratio (76.4%) for the nine bats are compared with each other, the bat of No. 7 has the maximum ball launch speed, and thus the bat of No. 7 is selected as a bat most suitable for batter B. Further, also in a case where it is assumed that the average hitting position ratio of batter B is 75%, 80%, or 85%, the maximum ball launch speed is achieved when the bat of No. 7 among the nine bats was used, and thus the bat of No. 7 is selected as the bat most suitable for batter B. That is, also in this case, there is no change in the bat selected as the bat most suitable for batter B (i.e., the bat of No. 7 in any case).

Referring to FIG. 20, when ball launch speeds calculated from the measured hitting position ratio (82.2%) for the nine bats are compared with each other, the bat of No. 9 has the maximum ball launch speed, and thus the bat of No. 9 is selected as a bat most suitable for batter C. Further, also in a case where it is assumed that the average hitting position ratio of batter C is 75%, 80%, or 85%, the maximum ball launch speed is achieved when the bat of No. 9 among the nine bats was used, and thus the bat of No. 9 is selected as the bat most suitable for batter C. That is, also in this case, there is no change in the bat selected as the bat most suitable for batter C (i.e., the bat of No. 9 in any case).

As described above, it is found that, for any of batters A to C having different measured hitting position ratios of 84.9%, 76.4% and 82.2%, respectively, there is no change in the bat selected as the most suitable bat in the case where the measured hitting position ratio is used and in the case where the assumed hitting position ratios (75%, 80%, 85%) are used. Accordingly, it is considered that there is no change in the bat selected as the most suitable bat as long as the assumed hitting position ratio is in the range of 75% to 85%. More suitably, the assumed hitting position ratio is desirably 80%, which is close to the average value of the hitting position ratios of all the 30 players shown in FIG. 5.

Thus, bat selection device 10 may calculate a ball launch speed by assuming the hitting position shown in the expression of FIG. 7 as a predetermined position on a bat (hereinafter also referred to as an "assumed hitting position"), and select a bat most suitable for a batter based on the calculated ball launch speed. The assumed hitting position is a position away from the grip end portion side of a bat by a value obtained by multiplying the total length of the bat by the assumed hitting position ratio (75%, 80%, or 85%). For example, in a case where the bat of 32 inches (total length: 813 mm) is used and the assumed hitting position ratio is 80%, the assumed hitting position is a position 650.4 mm away from the grip end portion side of the bat.

Next, a bat selection method in the case of using the assumed hitting position will be described. Since the bat selection method is identical concerning (Regarding Prepared Bats), (Selection of Bats to be Swung), (Calculation of Ball Launch Speed), and (Selection of Bat and Display of Result) described above, a detailed description thereof will not be repeated.

When the assumed hitting position is used, the swing parameter value is a swing speed immediately before a ball is hit by a bat. Specifically, bat selection device 10 (parameter input unit 230) receives an input of the swing speed measured by swing speed measurement device 20 (see FIG. 3A), for each of the at least two or more (for example, three) swung bats, through input device 120 (or communication interface 140).

Subsequently, bat selection device 10 (estimation unit 240) estimates a swing speed corresponding to each of the nine bats, based on each received swing speed and the assumed hitting position on the bat. Specifically, bat selection device 10 (estimation unit 240) first converts each received swing speed into an angular velocity about the grip end portion, based on the distance from one end on the grip side to an assumed position (i.e., the value obtained by multiplying the total length of the bat by the assumed hitting position ratio). Subsequently, bat selection device 10 obtains a relational expression between the converted angular velocity and the moment of inertia, and estimates a swing speed corresponding to each of the nine bats based on the obtained relational expression and the moments of inertia of the nine bats (see FIG. 6).

Then, bat selection device 10 (selection unit 250) calculates an index parameter value (a ball launch speed or a flying distance), for each of the nine bats, based on the assumed hitting position on the bat and the estimated swing speed corresponding to the bat, and selects a bat suitable for a batter from the nine bats.

Specifically, bat selection device 10 (selection unit 250) substitutes the assumed hitting position into the expression shown in FIG. 7 to obtain reduced mass M, and substitutes reduced mass M and the estimated swing speed into the expression shown in FIG. 8 to calculate a ball launch speed for each bat. Then, bat selection device 10 (selection unit 250) selects a bat having the maximum calculated ball launch speed among the nine bats as a bat suitable for the batter.

It is noted that the sensor device described above may be used instead of swing speed measurement device 20. In this case, the swing parameter value is an angular velocity measured by the sensor device. Specifically, bat selection device 10 (parameter input unit 230) receives an input of the angular velocity measured by the sensor device, for each of the three swung bats, through input device 120 (or communication interface 140). Subsequently, bat selection device 10 (estimation unit 240) estimates a swing speed corresponding to each of the nine bats based on each received angular velocity and the assumed hitting position on the bat. Specifically, bat selection device 10 obtains a relational expression between the angular velocity and the moment of inertia, and estimates a swing speed corresponding to each of the nine bats based on the obtained relational expression, the moments of inertia of the nine bats, and the assumed hitting position. Then, bat selection device 10 (selection unit 250) calculates an index parameter value, for each of the nine bats, based on the assumed hitting position on the bat and the estimated swing speed corresponding to the bat, and selects a bat suitable for a batter from the nine bats.

In addition, when the assumed hitting position is used, there is no need to measure a hitting position for hitting a ball, and thus it is not necessarily required to hit a ball. That is, bat selection device 10 can also select a bat suitable for a batter by having the batter make a practice swing. In this case, the swing parameter value is a swing speed measured by swing speed measurement device 20, or an angular velocity measured by the sensor device attached to a grip end portion of a bat or to the back of a hand of the batter.

It is noted that, when another swing speed measurement device is used, the maximum swing speed measured by the other swing speed measurement device, or a swing speed in the vicinity of timing at which the maximum swing speed is achieved may be used as the swing parameter value. Further, when another sensor device is used, the maximum angular velocity measured by the other sensor device, an angular velocity in the vicinity of timing at which the maximum angular velocity is achieved, or an average angular velocity around the vicinity of timing at which the maximum angular velocity is achieved may be used as the swing parameter value. The vicinity of timing at which the maximum swing speed or angular velocity is achieved refers to timing before, after, or before and after the above timing by a predetermined time (for example, about 1/100 seconds). Further, since ball mass $m_2$ in the expression shown in FIG. 8 is specification information, the mass of an actually used ball may be used therefor.

(Program)

It is noted that a program causing a computer to function and perform control as described in the above flowcharts can also be provided. Such a program can also be provided as a program product by being recorded in a non-transitory computer-readable recording medium attached to the computer, such as a flexible disk, a CD-ROM (Compact Disk Read Only Memory), a ROM, a RAM, a memory card, and the like. Alternatively, the program can also be provided by being recorded in a recording medium built in the computer, such as a hard disk and the like. Further, the program can also be provided by downloading through a network.

The program may be the one causing processing to be performed by invoking necessary modules from among program modules provided as a part of an operation system (OS) of the computer at predetermined timing. In that case, the program itself does not include the above modules, and processing is performed in cooperation with the OS. Such a program not including modules may also be included in the program in accordance with the present embodiment.

Further, the program in accordance with the present embodiment may be provided by being incorporated in a part of another program. Also in that case, the program itself does not include modules included in the other program, and processing is performed in cooperation with the other program. Such a program incorporated in the other program may also be included in the program in accordance with the present embodiment.

<Effects of Embodiment>

According to the present embodiment, since the moment of inertia of the bat and the hitting position for hitting the ball on the bat are taken into consideration, it is possible to easily and accurately provide a bat having a weight and a length most suitable for a batter, from among a plurality of bats having different weights and lengths.

Further, according to the present embodiment, it is possible to provide a bat most suitable for a batter in a simple way, without requiring a special bat.

Further, according to the present embodiment, by having the batter swing at least two or more bats of a prepared plurality of bats, a swing parameter value corresponding to each of the plurality of bats, including the bats which have actually not been swung, can be estimated. Therefore, it is possible to provide a bat most suitable for a batter without placing excessive strain on the batter.

Further, according to the present embodiment, by assuming the hitting position for hitting a ball as a predetermined position, it is possible to provide a bat suitable for a batter in a simpler way without the need for measuring the hitting position.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A bat selection device, comprising:

a parameter input unit configured to receive an input of a swing parameter value relevant to swing of a batter, for each of at least two or more bats having moments of inertia and total lengths different from one another swung by said batter at an object, of a plurality of bats;

an estimation unit configured to estimate said swing parameter value corresponding to each of said plurality of bats based on each said swing parameter value received by said parameter input unit;

a selection unit configured to calculate an index parameter value indicative of an index for selecting a bat suitable for said batter who has swung the bats from said plurality of bats, for each of said plurality of bats, based on said estimated swing parameter value corresponding to the bat, and select the bat suitable for said batter from said plurality of bats based on said calculated index parameter values;

wherein said swing parameter value includes a hitting position for hitting said object on the bat, and a swing speed at said hitting position immediately before said object is hit by the bat;

wherein said estimation unit is configured to convert, for each of said at least two or more bats which have been swung, said swing speed into an angular velocity about a grip end portion of the bat, obtain a relational expression between the moment of inertia and said angular velocity, and estimate the swing speed corresponding to each of said plurality of bats based on said obtained relational expression and moments of inertia of said plurality of bats; and wherein said selection unit is configured to calculate, for each of said plurality of bats, a speed of said object hit by the bat immediately after hitting, based on said hitting position and said swing speed corresponding to the bat, and select a bat having the maximum calculated speed as the bat suitable for said batter, from said plurality of bats.

2. The bat selection device according to claim 1, wherein said estimation unit is configured to calculate, for each of said at least two or more bats which have been swung, a ratio of a length from one end of the bat to said hitting position to a total length of the bat, and estimate said hitting position corresponding to each of said plurality of bats based on said calculated, ratio and total lengths of said plurality of bats.

3. The bat selection device according to claim 1, wherein said index parameter value includes a speed of said object hit by the bat immediately after hitting, or a flying distance of said object.

4. The bat selection device according to claim 1, further comprising:

a reference information storage unit configured to store batter information including at least one of age and physical characteristics of said batter, and selection reference information for selecting the bats to be swung by said batter, in a manner associated with each other;

a batter information input unit configured to receive an input of said batter information; and a candidate selection unit configured to select the at least two or more bats having the moments of inertia and the total lengths different from one another as candidates to be swung by said batter, from said plurality of bats, based on the batter information received by said batter information input unit and said selection reference information.

5. The bat selection device according to claim 1, wherein said hitting position is a measured hitting position on the bat obtained when said batter has hit said object.

6. The bat selection device according to claim 1, wherein said hitting position is a predetermined position on the bat.

7. A bat selection device, comprising:

a parameter input unit configured to receive an input of a swing parameter value relevant to swing of a batter, for each of at least two or more bats having moments of inertia and total lengths different from one another swung by said batter at an object, of a plurality of bats;

an estimation unit configured to estimate said swing parameter value corresponding to each of said plurality of bats based on each said swing parameter value received by said parameter input unit;

a selection unit configured to calculate an index parameter value indicative of an index for selecting a bat suitable for said batter who has swung the bats from said plurality of bats, for each of said plurality of bats, based on said estimated swing parameter value corresponding to the bat, and select the bat suitable for said batter from said plurality of bats based on said calculated index parameter values;

wherein said swing parameter value includes a hitting position for hitting said object on the bat, and an angular velocity measured by a sensor device attached to a grip end portion of the bat or to the back of a hand of said batter who has swung the bats;

wherein said estimation unit is configured to obtain, for each of said at least two or more bats which have been swung, a relational expression between the moment of inertia and said angular velocity, and estimate the swing speed corresponding to each of said plurality of bats based on said obtained relational expression and moments of inertia of said plurality of bats; and wherein said selection unit is configured to calculate, for each of said plurality of bats, a speed of said object hit by the bat immediately after hitting, based on said hitting position and said swing speed corresponding to the bat, and select a bat having the maximum calculated speed as the bat suitable for said batter, from said plurality of bats.

8. The bat selection device according to claim 7, wherein said estimation unit is configured to calculate, for each of said at least two or more bats which have been swung, a ratio of a length from one end of the bat to said hitting position to a total length of the bat, and estimate said hitting position corresponding to each of said plurality of bats based on said calculated ratio and total lengths of said plurality of bats.

9. The bat selection device according to claim 7, wherein said index parameter value includes a speed of said object hit by the bat immediately after hitting, or a flying distance of said object.

10. The bat selection device according to claim 7, further comprising:

a reference information storage unit configured to store batter information including at least one of age and physical characteristics of said batter, and selection reference information for selecting the bats to be swung by said batter, in a manner associated with each other;

a batter information input unit configured to receive an input of said batter information; and a candidate selection unit configured to select the at least two or more bats having the moments of inertia and the total lengths different from one another as candidates to be swung by said batter, from said plurality of bats, based on the batter information received by said batter information input unit and said selection reference information.

11. The bat selection device according to claim 7, wherein said hitting position is a measured hitting position on the bat obtained when said batter has hit said object.

12. The bat selection device according to claim 7, wherein said hitting position is a predetermined position on the bat.

13. A bat selection device, comprising:

a parameter input unit configured to receive an input of a swing parameter value relevant to swing of a batter, for each of at least two or more bats having moments of inertia and total lengths different from one another swung by said batter, of a plurality of bats;

an estimation unit configured to estimate said swing parameter value corresponding to each of said plurality of bats based on each said swing parameter value received by said parameter input unit;

a selection unit configured to calculate an index parameter value indicative of an index for selecting a bat suitable for said batter who has swung the bats from said plurality of bats, for each of said plurality of bats, based on a predetermined position on the bat and said estimated swing parameter value corresponding to the bat, and select the bat suitable for said batter from said plurality of bats based on said calculated index parameter values;

wherein said swing parameter value is a swing speed of said batter;

wherein said estimation unit is configured to convert, for each of said at least two or more bats which have been swung, said swing speed into an angular velocity about a grip end portion of the bat, obtain a relational expression between the moment of inertia and said angular velocity, and estimate the swing speed corresponding to each of said plurality of bats based on said obtained relational expression and moments of inertia of said plurality of bats; and wherein said estimation unit is configured to calculate, for each of said at least two or more bats which have been swung, a ratio of a length from one end of the bat to a hitting position to a total length of the bat, and estimate said hitting position corresponding to each of said plurality of bats based on said calculated, ratio and total lengths of said plurality of bats.

* * * * *